US008641585B2

(12) United States Patent
LaGree

(10) Patent No.: US 8,641,585 B2
(45) Date of Patent: Feb. 4, 2014

(54) EXERCISE MACHINE

(76) Inventor: Sebastien A. LaGree, Los Angeles, CA (US)

( * ) Notice: Subject to any disclaimer, the term of this patent is extended or adjusted under 35 U.S.C. 154(b) by 214 days.

(21) Appl. No.: 13/068,795

(22) Filed: May 20, 2011

(65) Prior Publication Data

US 2012/0295771 A1 Nov. 22, 2012

(51) Int. Cl.
*A63B 21/06* (2006.01)

(52) U.S. Cl.
USPC ..... 482/94; 482/92

(58) Field of Classification Search
USPC ..... 482/20–71, 92–96, 100, 121, 127, 482/131–135, 142, 148
See application file for complete search history.

(56) References Cited

U.S. PATENT DOCUMENTS

| | | | | |
|---|---|---|---|---|
| 3,770,267 | A | 11/1973 | McCarthy | |
| 3,892,404 | A | 7/1975 | Martucci | |
| 5,110,122 | A * | 5/1992 | Moore et al. | 482/134 |
| 5,653,670 | A | 8/1997 | Endelman | |
| 5,681,249 | A | 10/1997 | Endelman | |
| 5,792,033 | A | 8/1998 | Merrithew | |
| 5,830,115 | A | 11/1998 | Chen | |
| 5,906,564 | A | 5/1999 | Jacobsen | |
| 5,935,049 | A * | 8/1999 | Hamm | 482/140 |
| 5,961,430 | A * | 10/1999 | Zuckerman et al. | 482/142 |
| 6,120,425 | A | 9/2000 | Endelman | |
| 6,338,704 | B1 | 1/2002 | Endelman | |
| 6,471,624 | B1 * | 10/2002 | Voris | 482/142 |
| 6,527,685 | B2 | 3/2003 | Endelman et al. | |
| 6,595,902 | B1 | 7/2003 | Savage et al. | |
| 6,651,281 | B1 | 11/2003 | Figiel | |
| 6,726,608 | B1 * | 4/2004 | Hsu | 482/130 |
| 6,805,409 | B2 | 10/2004 | Parker | |
| 6,971,976 | B2 | 12/2005 | Endelman et al. | |
| 7,029,425 | B2 | 4/2006 | Krull | |
| 7,104,933 | B1 | 9/2006 | Liao | |
| 7,163,498 | B1 | 1/2007 | Abelbeck | |
| 7,163,500 | B2 | 1/2007 | Endelman et al. | |
| 7,384,381 | B2 * | 6/2008 | Webber et al. | 482/100 |
| 7,674,211 | B2 | 3/2010 | Uygan | |
| 7,682,297 | B2 | 3/2010 | Graham | |
| 7,803,095 | B1 * | 9/2010 | LaGree | 482/140 |
| 2006/0252613 | A1 | 11/2006 | Barnes et al. | |
| 2009/0048078 | A1 * | 2/2009 | Marcantonio | 482/92 |
| 2009/0108648 | A1 * | 4/2009 | Biggs et al. | 297/217.1 |
| 2011/0152032 | A1 * | 6/2011 | Barnett | 482/5 |

FOREIGN PATENT DOCUMENTS

| | | | |
|---|---|---|---|
| AU | 2004200589 | A1 | 3/2004 |
| DE | 198 32 235 | A1 | 1/2000 |

* cited by examiner

*Primary Examiner* — Loan Thanh
*Assistant Examiner* — Andrew S Lo
(74) *Attorney, Agent, or Firm* — Todd N. Hathaway

(57) ABSTRACT

An exercise machine having a rolling platform and adjustable bar members. The platform is supported on frame rails, and is biased by springs towards an end of the machine. The rails have a rectangular cross-section angled 45° to horizontal, and roller assemblies on the platform include wheels angled to engage the surfaces of the rails substantially normal thereto. The adjustable bar assemblies include upwardly extending bars having upper members that are rotatable about a generally vertical axis so that handle portions at the upper ends thereof extend in different direction. At least one of the bar assemblies is also selectively pivotable about a horizontal axis to positions in which it is engaged by a locking assembly on the frame of the machine. The machine enables the user to perform a wide variety of exercises in reclined, prone, seated and standing positions, both on and off the platform.

24 Claims, 30 Drawing Sheets

EXERCISE MACHINE

BACKGROUND a. Field of the Invention

The present invention relates generally to machines for performing physical exercises, and more particularly, to an improved exercise machine that enables a person to perform a wide range of repetitive exercises in reclined, prone, seated and standing positions.

b. Related Art

The present invention relates somewhat to the Pilates Method physical fitness system, but provides the ability to perform certain exercises not heretofore possible with conventional Pilates-type equipment.

By way of background, the Pilates Method physical fitness system was initially developed by Joseph Pilates. A German national of Greek decent, Pilates conducted physical fitness training for police officers in Britain prior to World War I. Pilates was also trained as a nurse, and while interned in Britain during World War I he investigated ways to rehabilitate bedridden victims of the 1918 influenza pandemic. The system that he developed consequently utilized a series of movements that could be practiced within the confines of a hospital or other rehabilitation environment. The principal piece of equipment, the Pilates Reformer, was in turn based on an old hospital bed, with some resemblance to earlier rowing machines.

In the Pilates Method, persons for the most part use their own bodies as "weights" in training, to build strength and flexibility. The method emphasizes proper alignment, centering, concentration, control, precision, breathing, and flowing movement, which result in increased flexibility, strength, muscle tone, body awareness, energy, and improved mental concentration. The method continues to be used in the rehabilitation process, but is most often practiced for purposes of personal fitness.

As befits its humble origins, the Pilates Reformer is a relatively simple piece of equipment. Although differences exist depending on make and model, the basic components are essentially the same: A stationary frame supports a platform that slides back and forth on tracks, with resistance being provided by elastic cords or springs. A foot bar is mounted at one end of the frame and shoulder pads are typically mounted on the platform, so that a person can perform leg exercises while reclining on the platform. A pair of ropes are frequently routed over pulleys at the head end of the frame, so that the person in turn can perform arm and upper body exercises while seated on the platform.

While the Reformer has proven highly successful for its intended purpose, it is not without limitations. To begin with, its ability to conduct exercises other than those listed above is very limited. As a result, certain muscle groups cannot be effectively exercised using the Reformer alone. Joseph Pilates designed other pieces of equipment to conduct exercises not possible with the Reformer, but additional equipment also means additional costs and space requirements. Moreover, certain beneficial exercise motions are difficult or impossible to perform even with the additional pieces of equipment that Pilates designed.

A somewhat more subtle drawback of the conventional Reformer machine relates to an evolving divergence in philosophy from the traditional Pilates Method. As noted above, the principle objectives of the conventional Pilates Method are flexibility, strength and balance. Although desirable goals in themselves, persons engaged in modern fitness regimens very frequently wish to achieve enhanced physical aesthetics as well; specifically, individuals often wish to increase muscle mass in certain areas, such as the pectoral, glutial and abdominal muscles, for example. The original Pilates Method is founded on a comparatively small number of repetitions of precisely controlled movements, to which the conventional Reformer machine is tailored, but such a regimen does not significantly increase muscle mass beyond a relatively limited point.

Certain modern machines have been developed that may be considered to be improvements on or successors to the Pilates Reformer, but the need nevertheless remains for machines offering a degree of variation and sophistication in the exercises that can be performed. Furthermore, to be successful in a modern studio environment, such machines need to be not only comfortable and user friendly, but also adequately durable for sustained usage by multiple classes virtually every day of the year, while remaining sufficiently affordable that a studio can reasonable be outfitted with multiple units.

Accordingly, there exists a need for an exercise machine that allows a person to perform the exercises of which a conventional Pilates Reformer is capable, plus additional exercises in various standing, seated, prone and reclined positions. Furthermore, there exists a need for such an exercise machine that enables the person to perform exercises that effectively increase mass in various muscle groups, in order to achieve the goal of improved physical aesthetics. Still further, there exists a need for such an exercise machine that is well suited to use in the environment of a modern exercise studio or similar facility, and that allows the desired exercises to be performed by a group of individuals using a single type of machine. Still further, there exists a need for such an exercise machine that is durable and able to sustain extended use in a studio environment, and that also can be constructed in an efficient and economical manner.

SUMMARY OF THE INVENTION

The present invention addresses the problems cited above, and provides an exercise machine comprising: (a) a frame having first and second ends; (b) a platform mounted on the frame so as to be reciprocatingly movable towards the first and second ends thereof; and (c) at least one bar assembly comprising a pair of upright bars mounted on opposite sides of the frame, the upright bars each comprising a lower bar member extending generally upwardly from the frame, an upper bar member having a grip portion extending generally horizontally so as to be accessible to a user on the platform, and a coupling rotatably connecting the upper bar member to the lower bar member so that the generally horizontal grip portion is selectively rotatable to a plurality of positions for differing exercises performed on the machine.

The couplings rotatably connecting the upper bar members to the lower bar members may each comprise a first coupling member mounted to an upper end of the lower bar member, a second coupling member mounted to a lower end of the upper bar member, and means for yieldingly biasing the first and second coupling members into a locking engagement, so that in response to a user lifting the upper bar segment the first and second coupling members are separated from the locking engagement to allow the grip portion to be rotated to a selected position, and in response to a user releasing the upper bar member the first and second coupling members are biased into the locking engagement so as to retain the grip portion in the selected position. The means for biasing the first and second coupling members into the locking engagement may comprise a spring yieldingly biasing the lower end of the upper bar member having the second coupling member mounted thereon towards the upper end of the lower bar member having the first coupling member mounted thereon. The first and second coupling members may comprise first and second castellated members having cooperating teeth and notches that form the locking engagement.

The at least one bar assembly may further comprise a horizontal axis pivot connection between the bar assembly and the frame that allows the upwardly extending bars to be selectively rotated about a horizontal axis to a plurality of angles for differing exercises performed on the machine. The horizontal axis pivot connection may comprise a horizontal cross-member interconnecting the lower bar members of the first and second bars, and at least one bearing mounted to the frame that supports the cross-member for rotation about the horizontal axis relative to the frame. The machine may further comprise means for selectively locking the upright bars in the plurality of angular positions. The means for selectively locking the bars in the angular positions may comprise a retractable plunger member mounted to at least one of the lower bar members, a locking member mounted to the frame and having a plurality of openings that receive the plunger member in locking engagement therewith when the bars are in the angular positions, and means for selectively retracting and extending the plunger member on the bar member from and into the openings in the locking member. The means for selectively retracting and extending the plunger member may comprise a cable connecting the plunger member to an upper bar member via the lower bar member, so that in response to a user lifting the upper bar member tension on the cable retracts the plunger member from the openings in the locking members, and in response to a user releasing the upper bar member slack in the cable allows the plunger member to extend into the openings in the locking member; the spring tensioning the lower end of the upper bar member towards the upper end of the lower bar member may comprise a compression spring mounted intermediate the plunger member and the lower bar members so as to exert tension on the cable while biasing the plunger member towards an extended position.

The frame may comprise first and second substantially parallel rail members that support cooperating rail assemblies on the platform. The rail assemblies may each comprise a downwardly sloped upper surface and an upwardly sloped lower surface converging towards a medial side of the rail member. The downwardly sloped upper surface and upwardly sloped lower surface may extend at angles of about 45° to horizontal, and the first and second rail members may comprise first and second substantially rectangular tube members mounted so that the sides thereof extend at angles of approximately 45° to horizontal. The roller assemblies may each comprise at least one upper roller wheel that engages one of the sloped upper surfaces of the rail members substantially normal thereto, and at least one lower roller wheel that engages one of the sloped lower surfaces of the rail members substantially normal thereto. The roller members may be mounted in outwardly facing pairs on opposite sides of the platform, the pairs of roller assemblies being spaced apart by a distance sufficient that the sloped upper and lower surfaces of the medial sides of the rail members are captured between the upper and lower roller wheels so as to restrict vertical movement of the platform relative to the frame.

The machine may further comprise means for yieldingly biasing the platform towards one of the ends of the frame. The means for yieldingly biasing the platform towards one of the ends of the frame may comprise at least one tension spring interconnecting the platform and the frame.

In a preferred embodiment, the present invention provides an exercise machine comprising: (a) a frame assembly having a head end and a foot end, the frame assembly comprising first and second parallel, spaced apart rail members having rectangular cross-sections, the rail members being mounted level with one another and with sides extending at angles of approximately 45° to horizontal so that medially facing sides of the first and second rail members form downwardly sloped upper surfaces and upwardly sloped lower surfaces; (b) a platform assembly located on the rail members, the platform assembly comprising a generally horizontal platform member, a plurality of roller assemblies that support the platform member on the rail members for movement thereover towards the head end and foot end of the frame assembly, the roller assemblies each comprising upper and lower roller members that engage the sloped upper and lower surfaces of one of the rail members substantially normal thereto, the roller assemblies being mounted in opposing pairs on the platform member and spaced apart laterally by a distance sufficient that the medially facing sides of the first and second rail members are captured intermediate the opposing pairs of roller assemblies so as to restrict vertical movement of the platform assembly on the frame assembly, and at least one tension spring yieldingly biasing the platform towards the foot end of the frame assembly; and (c) first and second adjustable bar assemblies mounted to the frame assembly proximate the head end and foot end thereof, each bar assembly comprising a pair of upright bars mounted on opposite sides of the frame assembly, the upright bars each comprising a lower bar member extending generally upwardly from the frame assembly, an upper bar member having a grip portion extending generally horizontally so as to be accessible to a user on the platform, and a coupling rotatably connecting the upper bar member to the lower bar member so that the generally horizontal grip portion is selectively rotatable to a plurality of positions for differing exercises performed on the machine, the coupling comprising a first coupling member mounted to an upper end of a lower member, a second coupling member mounted to a lower end of the upper bar member, and a spring yieldingly biasing the first and second coupling members into a locking engagement, so that in response to a user lifting the upper bar segment the first and second coupling members are separated from the locking engagement to allow the grip portion to be rotated to a selected position, and in response to a user releasing the upper bar member the first and second coupling members are biased into the locking engagement so as to retain the grip portion in the selected position; (i) the first adjustable bar assembly mounted proximate the head end of the frame assembly further comprising means for fixedly mounting the lower bar members of the first bar assembly to the first and second rail members proximate the head end of the frame assembly, and (ii) the second adjustable bar assembly mounted proximate the foot end of the frame assembly comprising a horizontal pivot axis connection between the second bar assembly and the frame that allows the upwardly extending bars thereof to be selectively rotated about a horizontal axis to a plurality of angles for differing exercises performed on the machine. The means for fixedly mounting the lower bar members of the first bar assembly to the first and second rail members proximate the head end of the frame assembly may comprise a mounting flange on a lower portion of each of the bar members that bears generally flat against a downwardly sloped upper surface of one of the rail members and at least one fastener securing the mounting flange to the rail member. The horizontal axis pivot connection between the second bar assembly and the frame assembly may comprise a horizontal cross-member interconnecting the lower bar members of the second bar assembly, at least one bearing mounted to the frame assembly proximate the foot end thereof that supports the cross-member for rotation about the pivot axis relative to the frame assembly, and means for selectively locking the upright bars in the plurality of angular positions.

The present invention further provides an adjustable bar assembly for an exercise machine, the adjustable bar assembly comprising a pair of upright bars mountable on opposite sides of a frame of an exercise machine, the upright bars each comprising a lower bar member extending generally upwardly from the frame, an upper bar member having a grip portion extending generally horizontally so as to be accessible to a user on the exercise machine, and a coupling rotatably connecting the upper bar member to the lower bar member so that the generally horizontal grip portion is selectively rotatable to a plurality of positions for differing exercises performed on the machine, the coupling comprising a first coupling member mounted to an upper end of the lower bar member, a second coupling member mounted to a lower end of the upper bar member, and means for yieldingly biasing the first and second coupling members into a locking engagement, so that in response to a user lifting the upper bar segment the first and second coupling members are separated from the locking engagement to allow the grip portion to be rotated to a selected position, and in response to a user releasing the upper bar member the first and second coupling members are biased into the locking engagement so as to retain the grip portion in the selected position. The means for biasing the first and second coupling members into the locking engagement may comprise a spring yieldingly biasing the lower end of the upper bar member having the second coupling member mounted thereon towards the upper end of the lower bar member having the first coupling member mounted thereon.

These and other features and advantages of the present invention will be more fully appreciated from a reading of the following detailed description with reference to the accompanied drawings.

DETAILED DESCRIPTION a. Overview

Figure 1:
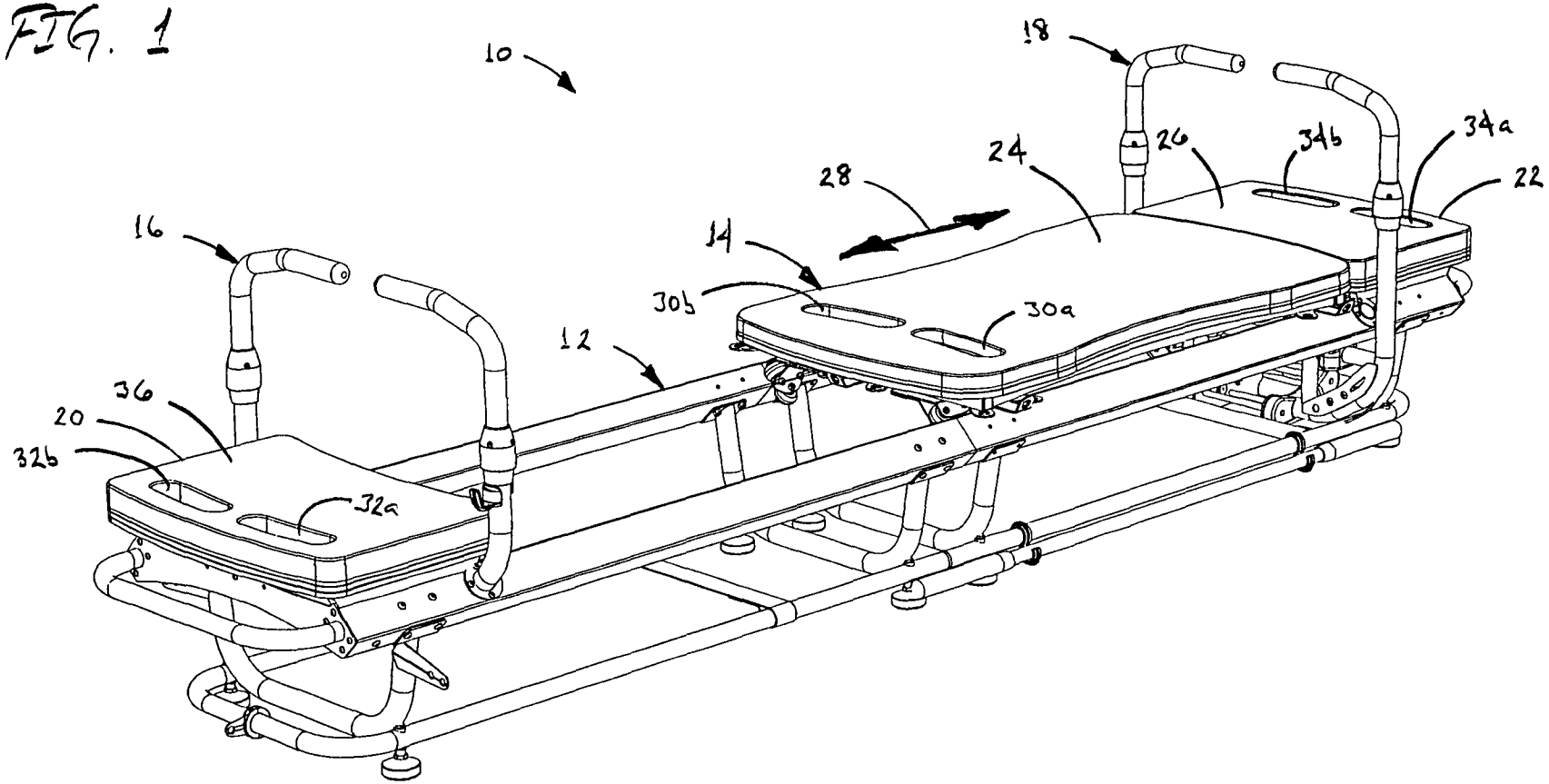
FIG. 1 is a first perspective view of an exercise machine in accordance with a preferred embodiment of the present invention, viewed from the head end of the machine.
Figure 2:
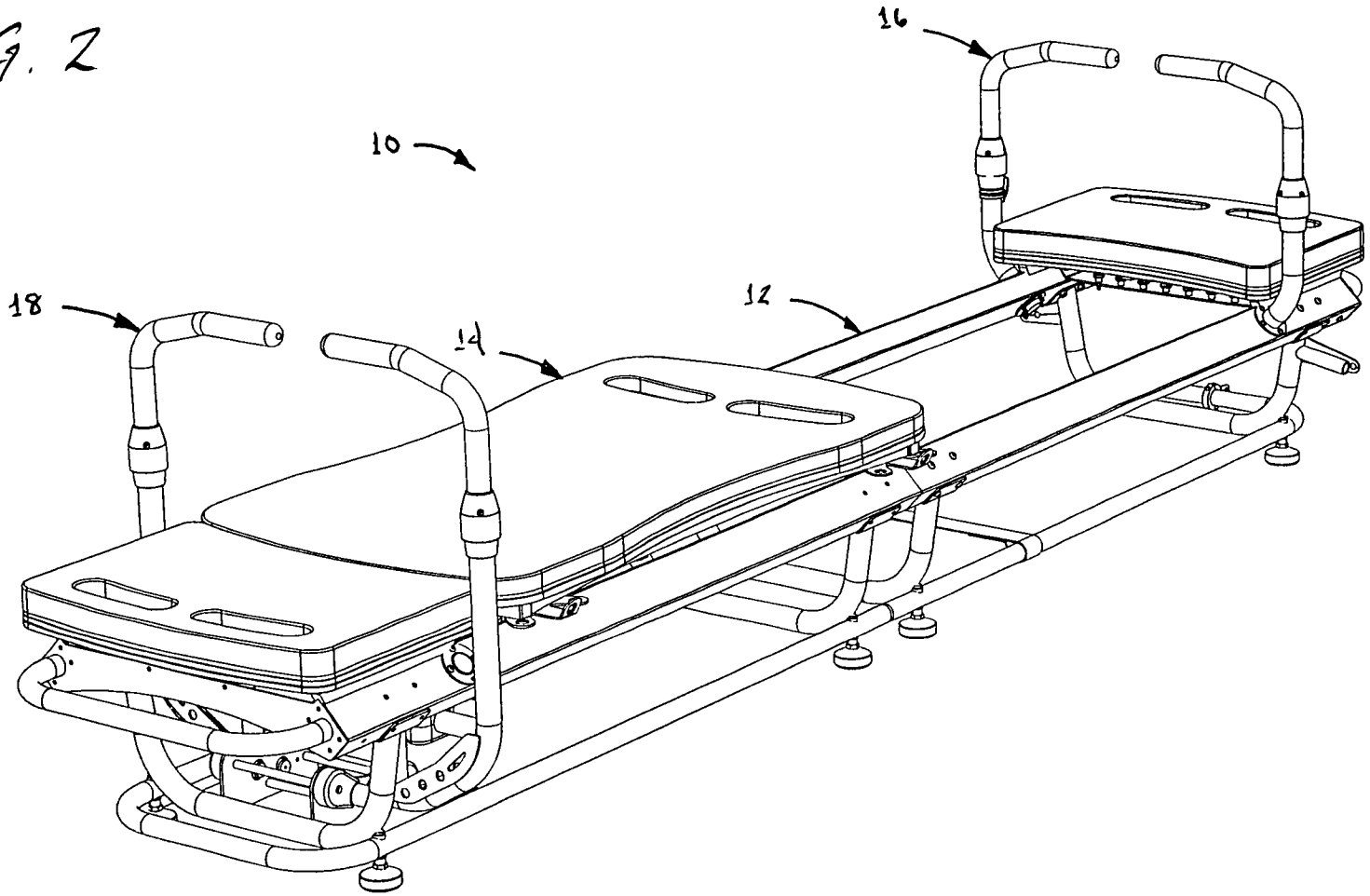
FIG. 2 is a second perspective view of the exercise machine of FIG. 1, viewed from the foot end of the machine, towards which the moving carriage assembly of the machine is biased by spring tension.

FIGS. 1-5 show an exercise machine 10 in accordance with a first preferred embodiment of the present invention. As can be seen therein, the machine includes an elongate, generally horizontal frame 12 that stands upon the floor or other substrate and provides the connections and support for the other assemblies of the machine. These include a wheeled platform assembly 14 that cooperatingly engages the frame assembly for reciprocating movement thereon, the platform being spring-biased towards a foot end of the frame as will be described in greater detail below. A first adjustable bar assembly 16 is mounted to the frame assembly 12 proximate the head end thereof, while a second adjustable bar assembly 18 is mounted proximate the foot end of the frame. In addition, stationary platforms 20, 22 are mounted at the head and foot ends of the frame assembly, distally of the respective adjustable bar assemblies 16, 18.

As used herein, "head end" and "foot end" reference the orientation of a person's body in most exercises when reclined (supine) on platform 14, that is, the person's head and shoulders will be towards the "head end" of the machine and the person's legs and feet will be towards the "foot end". It will be understood, however, that the terms are somewhat arbitrary in nature, in the sense that the person's head and feet may be directed towards one end or the other of the machine when performing a variety of exercises made possible by the machine, for example, in standing positions, sitting positions, and so on.

For example, a person may recline on his back on the upper surface 24 of the platform assembly 14 and place his feet on the surface 26 of stationary platform 22, and exercise by using the legs and associated muscles to reciprocate the moving platform 14 away from and towards the stationary platform 22 as indicated by arrow 28 in FIG. 1. To perform a different exercise the person may place the toes of his feet in openings 30*a*, 30*b* proximate the head end of the platform while grasping the upper ends of the foot end of the bar assembly 18, and again work the legs and lower body to reciprocate the platform in the directions indicated by arrow 28; the position may be reversed, with the toes inserted in openings 30*a*, 30*b* and hands gripping the head end of bar assembly 16, to again work the muscles against the spring tension biasing the platform towards the foot end of the frame. In another position, the user's feet may be inserted in openings 32*a*, 32*b* located proximate the distal edge of the head-end stationary platform 20 while the hands are inserted in openings 30*a*, 30*b* of the moving platform, and openings 34*a*, 34*b* formed in the foot end platform 22 can similarly be employed as foot holds or hand holds in conjunction with the openings 30*a*, 30*b* of the moving platform. Still further, the person may perform additional exercises standing or kneeling on the surfaces 26, 36 of the stationary end platforms, for example, pulling on ropes (not shown) attached to moving platform 14 by an arrangement of pulleys. Also, the person may perform exercises using the machine while standing on the floor, for example, while grasping one of the bar assemblies 16, 18. To facilitate the numerous exercises that can be performed using the machine, the bar assemblies are adjustable to a variety of angular positions, as will also be described in greater detail below.

The exercise machine of the present invention is thus extraordinarily versatile, and lends itself to performing a broad spectrum of exercises that can be performed as part of a sophisticated strength and/or toning regimen in a studio environment. Moreover, as will be described below, the structure of the machine is such that it can be manufactured economically, while at the same time having sufficient strength and durability to be suitable for commercial/institutional use.

For ease of understanding, each of the major assemblies of the machine will be described in a separate section below, with reference to FIGS. 6-23.

b. Frame Assembly

Figure 6:
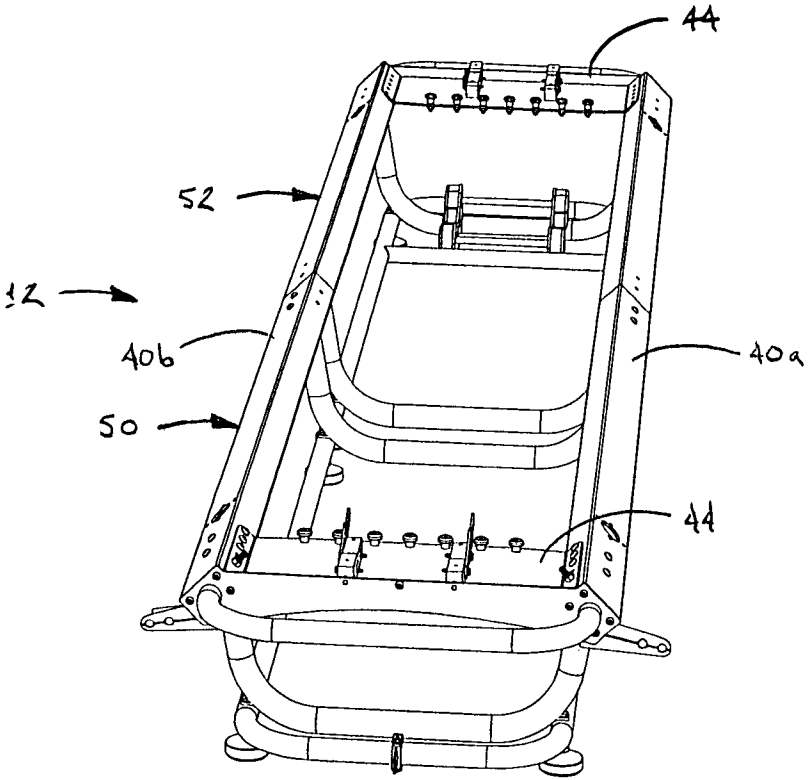
FIG. 6 is a perspective view of the frame assembly of the exercise machine of FIGS. 1-5.
Figure 7:
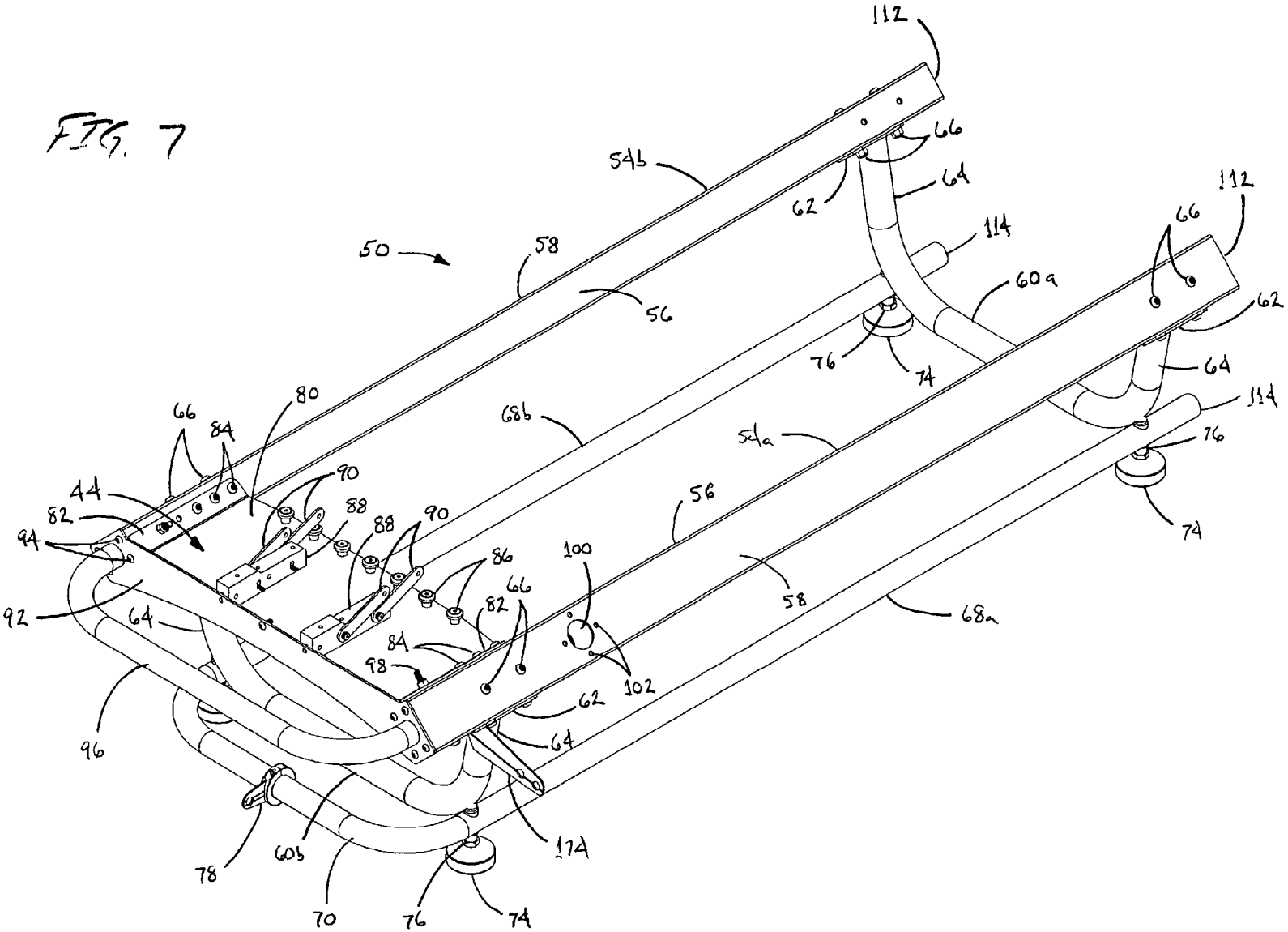
FIG. 7 is an enlarged perspective view of the head-end section of the frame assembly of FIG. 6, showing the construction thereof in greater detail and also the manner in which it is separable from the other section of the frame.
Figure 8:
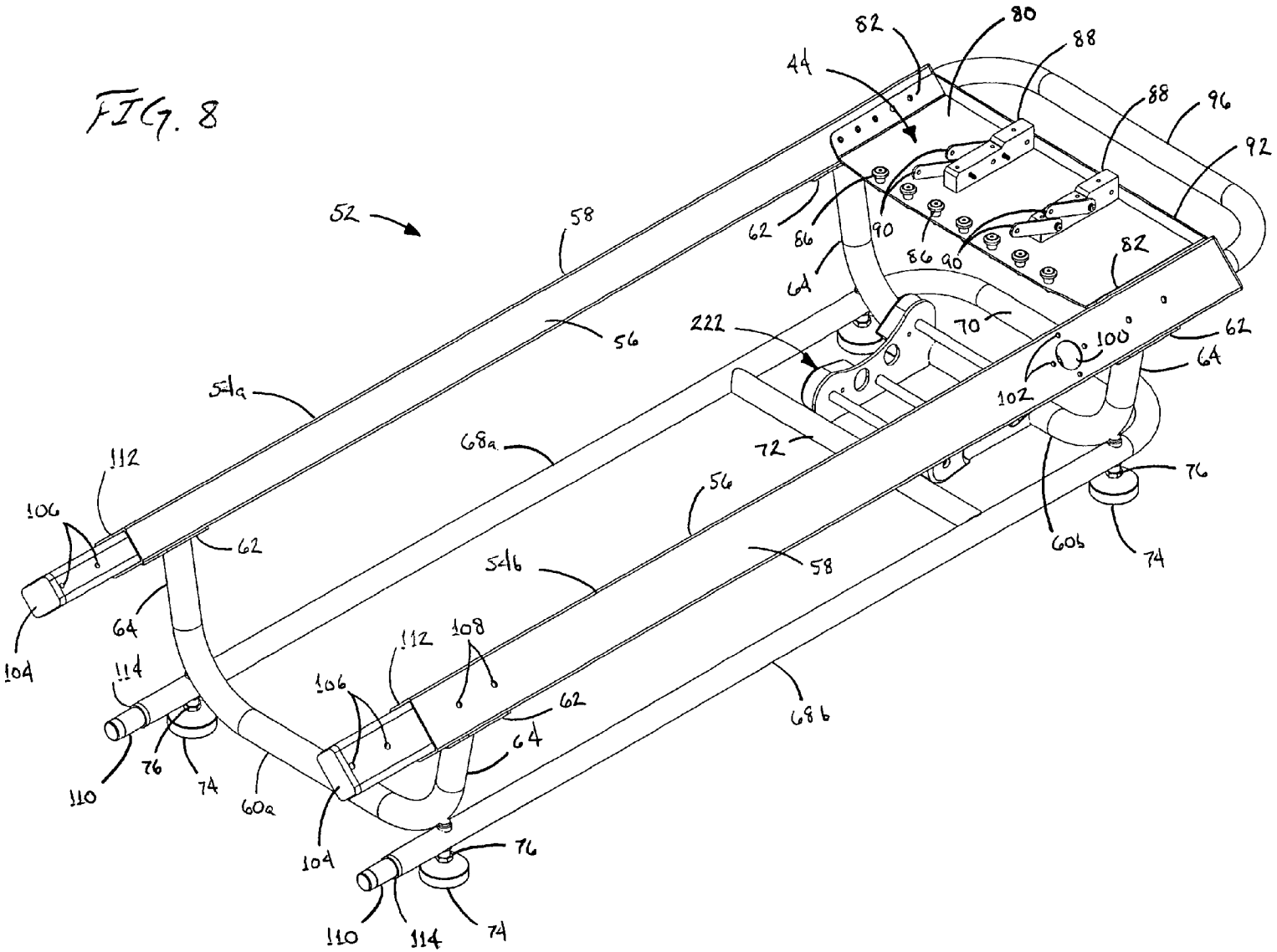
FIG. 8 is a perspective view of the foot-end section of the frame of FIG. 5, showing its construction in greater detail and also the structure by which it is joined to the first section of the frame.
Figure 9:
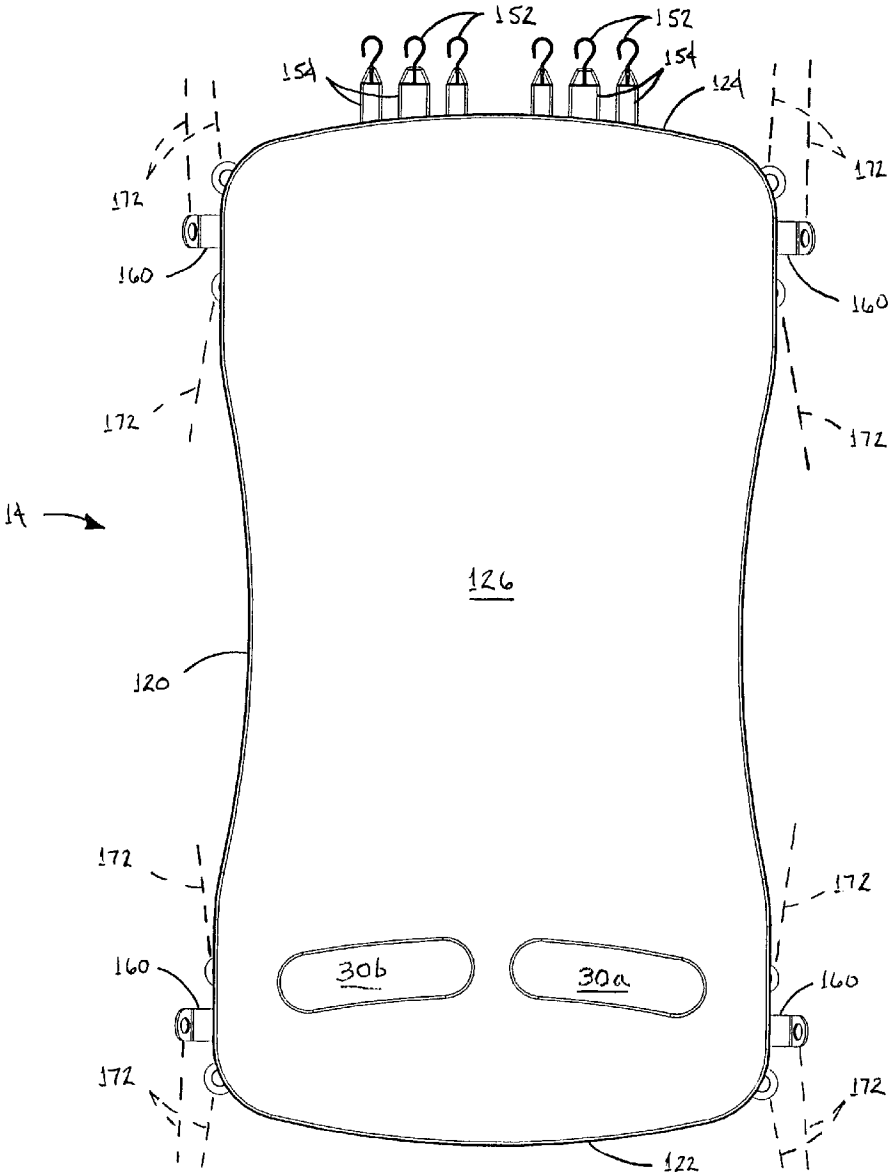
FIG. 9 is a top plan view of the moving carriage assembly of the exercise machine of FIGS. 1-5.

FIGS. 6-8 show the structure of the frame assembly 12 in greater detail. As noted above, and as can be seen in FIG. 6, the frame assembly has a generally rectangular configuration in plan view, with first and second elongate side rails 40*a*, 40*b* joined by cross pieces 44 at the head and foot ends of the frame.

In the embodiment that is illustrated, the frame assembly 12 is constructed in two sections 50, 52, which provides significant advantages in terms of packing and shipping costs. As can be seen in FIGS. 7-8, each of the frame sections 50, 52 is substantially identical, with the exception of detail components that may be installed during final assembly, which not only simplifies manufacture but also enables components to be reversed to even out wear and thereby extend the life of the machine. Since the frame sections are substantially identical overall, like reference numerals will be used with respect to like structures in the following description.

As can be seen in FIGS. 7 and 8, each of the frame sections includes first and second spaced apart, parallel rail segments 54*a*, 54*b* that meet in end-to-end relationship to form the main rails 40*a*, 40*b* of the machine. The rail segments each have medial and lateral sloped upper surfaces 56, 58, that are preferably angled approximately 90° to one another, and are suitably constructed of rectangular cross section steel tubing. As used herein, the term medial and lateral refer to the sides of the rails disposed towards and away from the longitudinal centerline of the frame assembly.

The rail segments 54*a*, 54*b* are supported proximate each end atop generally U-shaped cross members 60*a*, 60*b* the rail segments being mounted to V-shaped saddle brackets 62 on the upwardly projecting ends 64 of the latter by bolts 66. The U-shaped cross members are suitably constructed of bent cylindrical steel tubing, the lower ends of the upright portions 64 being joined by welding or other suitable means to spaced apart, parallel longitudinal members 68*a*, 68*b*, which are also suitably formed of cylindrical steel tubing. The lower frame members 68*a*, 68*b* are located relatively near to the floor or other underlying surface, and are joined across the frame end by a transverse segment 70, that may be formed integrally with the longitudinal segments 68*a*, 68*b*. An additional cross member 72 is mounted between the longitudinal members 68*a*, 68*b* a spaced distance from the end cross member 60*b* to provide support for the locking plate subassembly 222 of the foot-end bar assembly, as will be described in greater detail below.

A plurality of foot members 74, preferably one at each of the four corners of each frame section, are mounted to and extend downwardly from the lower frame members 68*a*, 68*b*, and preferably include threaded adjusters 76 or other mechanisms that permit the frame to be leveled on the floor or other underlying surface.

At the head end of frame section 50 an eye fitting 78 is mounted to the lower frame cross member 70, for attachment of a ring or carabineer to form a connection to a pulley or rope, for example.

As can be seen with further reference to FIGS. 7-8, the transverse bridge portions 44 at the ends of each of the frame assemblies 50, 52 include flat, somewhat tray-shaped panel members 80 that fill the span between the inside edges of the two rail segments 54*a*, 54*b*, and that include upwardly and outwardly angled flange portions 82 that mate flatly against the medial upper sloped surfaces 56 of the rail segments and are mounted thereto by bolts 84 or similar fasteners. A row of upstanding, mushroom-shaped pegs 86 is mounted along the forward edge of each of the bridge panels 80, for attachment of cooperating end loops of tension springs connected to the rolling platform assembly, as will be described in greater detail below. A pair of block members 88 are mounted to each bridge panels rearwardly of the spring attachment pegs, the blocks providing horizontal-axes pivot connections for pairs of legs 90 to which the end platforms 20, 22 (see FIG. 1) are mounted, thus allowing the user to raise and pivot the end platforms out of the way from over the row of attachments pegs 86, to provide access for attachment/detachment of tension springs as desired.

Distally of the bridge panel, a vertical end plate 92 is mounted to the ends of the rail segments 54*a*, 54*b* by bolts 94, and provides support for generally U-shaped bar member 96 that spans the ends of the rail segments, to provide a handle area for various exercises, as well as enhancing the structural integrity of the frame assembly. Threaded plug members (not shown) are installed in the ends of the tubular rail segments and held in place by through bolts 98, to facilitate installation of the longitudinally extending bolts 94.

As is also shown in FIGS. 7-8, circular bores 100 and bolt holes 102 are formed in the rail segments 54*a*, 54*b* proximate and just slightly forward of the bridge panels 80, for attachment of the adjustable arm assemblies as will be described below.

To assemble the frame 12, alignment blocks 104 are first inserted into the open ends of the rail segments 54*a*, 54*b* of one or the other of the frame sections. The alignment blocks have a generally rectangular cross-section sized and configured such that the blocks can be inserted axially into the cooperating hollow interiors of the rail segments in close-fitting engagement therewith, and include bores 106 that align with bores 108 formed in the rail segments for bolts 66 when the sections are brought together. Similarly, close-fitting cylindrical alignment plugs 110 are inserted into the ends of the tubular lower frame members 68*a*, 68*b*. The plug members are preferably formed of a material having sufficient strength and rigidity to avoid excessive flexing or looseness at the connection between the two frame sections, with rigid plastic being eminently suitable for this purpose.

With the alignment plugs thus in place, the corresponding ends of the frame sections 50, 52 are brought into position so that the protruding ends of the plugs enter their counterpart openings in the opposite frame section, and the two frame sections are then pushed together until the ends 112, 114 of the tubular rail segments and frame members meet in abutment. The remaining bolts 66 are then installed so that the frame sections are secured together tightly and rigidly via the plug members, with the rail segments meeting in alignment to form the rails 40*a*, 40*b* on the two sides of the machine.

c. Platform Assembly

As can be seen in FIGS. 9-12, the rolling platform assembly 14 includes a platform 120 having head and foot ends 122, 124 and a generally planar upper surface 126 sized to accommodate the torso, shoulders and head of a person reclining thereon. The upper surface is preferably cushioned, and in the illustrated embodiment the platform is constructed of a cushioning pad 128 overlying a correspondingly shaped rigid structural panel 130. The pair of foot openings 30*a*, 30*b* are formed through the platform 120 proximate the head end thereof, for receiving the toes of a person's feet in performing various exercises. In addition, as will be described in greater detail below, posts, pads or similar structures for bearing against the user's shoulders may also be provided towards the head end of the platform.

Figure 10:
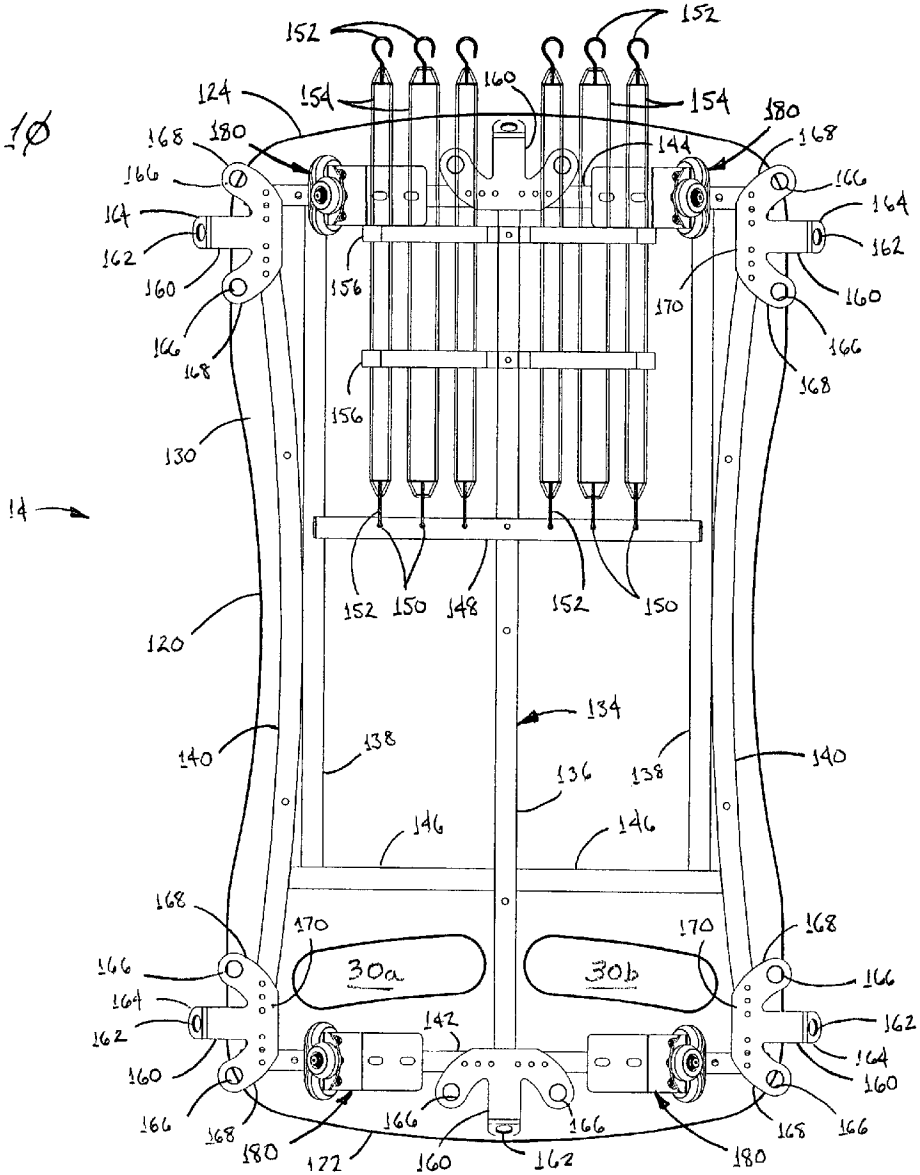
FIG. 10 is a bottom plan view of the moving carriage assembly of FIG. 9, showing the lower structure thereof and the tension springs that bias the platform towards the foot end of the machine.
Figure 11:
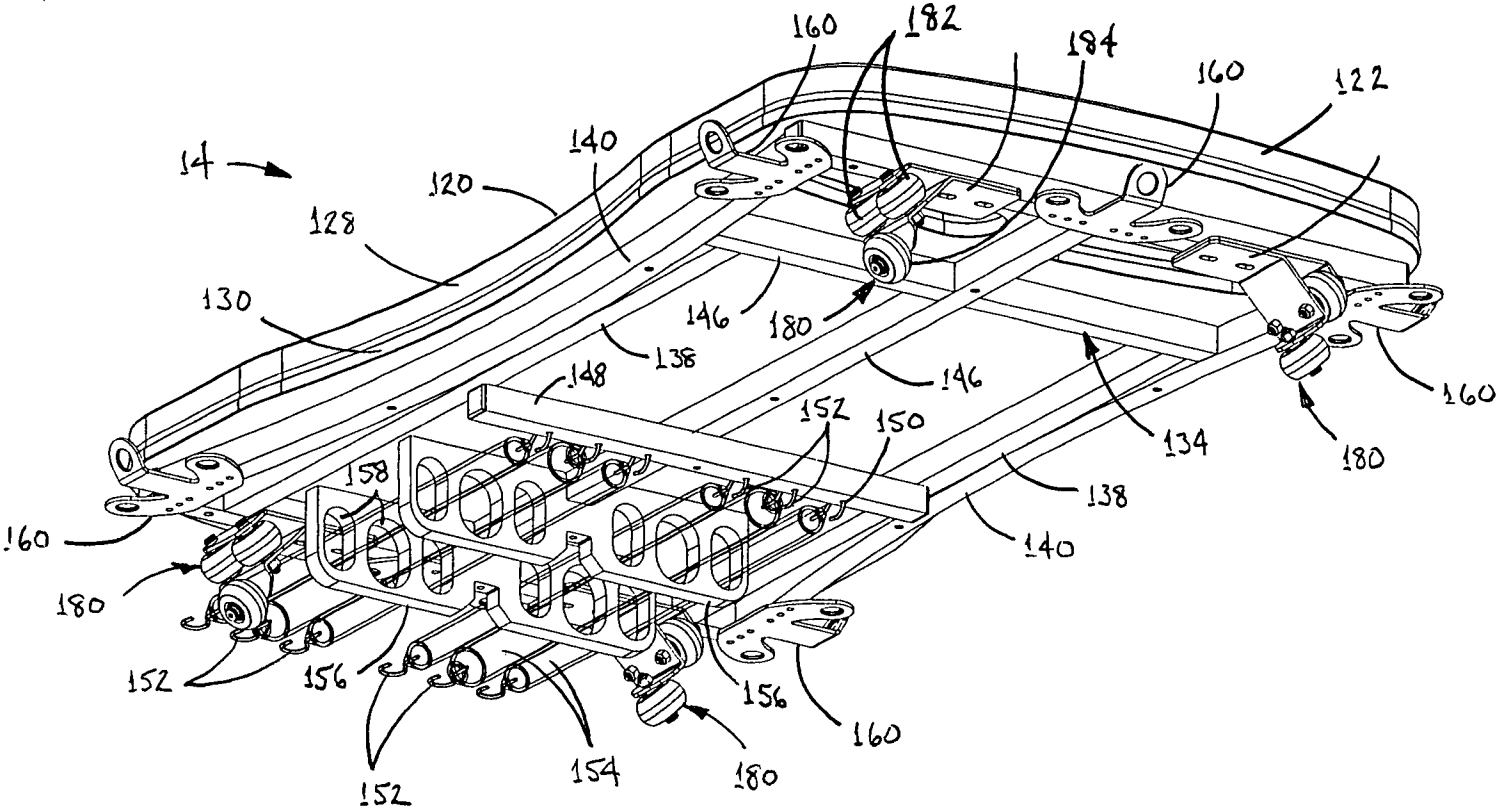
FIG. 11 is a bottom perspective view of the carriage assembly of FIGS. 9-10, showing in greater detail the structure thereof, including the angled roller assemblies that support the platform for movement atop the rails of the frame assembly of FIGS. 6-8.

As can be seen in FIGS. 10-11, an underframe 134 is mounted to the bottom of the rigid platform panel 130, to provide both structural rigidity and attachment points for load-transmitting fittings, and includes a central longitudinal member 136 and inner and outer longitudinal side members 138, 140, spanned by cross-members 142, 144 proximate the head and foot ends 122, 124 of the platform and 146 rearwardly of the foot openings 30*a*, 30*b*. An additional cross-member 148 forms a bridge piece mounted across the bottom of the longitudinal members 136, 138, and includes a series of bores 150 arranged in a row to provide anchor points for attachment of hooks 152 formed on the ends of coil tension springs 154, the opposite ends of the tension springs having additional hooks 152 for attachment to the pegs 86 of the frame assembly as described above. First and second parallel guide plates 156 are mounted across the central frame member 136, at spaced locations between the anchor member 148 and the foot end 124 of the platform, and include openings 158 through which the springs 154 are routed so as to be held generally in alignment against bending, sagging or shaking during use while tension is released, e.g., when the ends of the springs are detached from the anchor pegs. The members of the outer frame 134, as well as the anchor member and guide plates, may suitably be constructed of wood or similar materials.

As can be seen with further reference to FIGS. 10-11, connector brackets 160 are mounted proximate each of the four corners of the underframe 134, at the junctions between the outboard longitudinal members 140 and transverse members 142, 144, with additional brackets 160 being mounted on the transverse members at the ends of the centerline longitudinal member 136 proximate the head and foot ends 122, 124 of the platform. Each of the connector brackets includes three eyes for attachment of ropes and/or pulleys thereto (either directly or via attachment hardware such as a ring or carbineer), namely, a central eye 162 formed in a projecting, upwardly angled flange 164 and first and second outboard eyes 166 formed in flat, horizontal flanges 168 that extend from a horizontal base flange that is mounted to the frame members by screws or other suitable fasteners.

The attachment eyes of the brackets 160 are accessible at the edges of the rolling platform 120, around the head and foot ends 124, 122 thereof. Connected as described above, the connector brackets enable the user to exert tension on the platform in various directions, examples being indicated generally by dotted lines 172 in FIG. 9, so as to exercise against the tension of the springs connecting the platform to the frame. For example, pulleys may be mounted to extension brackets 174 (one only being visible in FIG. 7) on the sides of the head end of the frame assembly, and ropes routed from brackets 160 at the sides of the head of the platform over the pulleys and back to the platform, so that a user on the platform can exert a tension on the ropes drawing the platform away from the foot end of the frame against the resistance exerted by springs 154. Similarly, tension can be applied to ropes attached to the connector brackets by users standing or kneeling on the end platforms, or off the ends of the machine completely.

Figure 12:
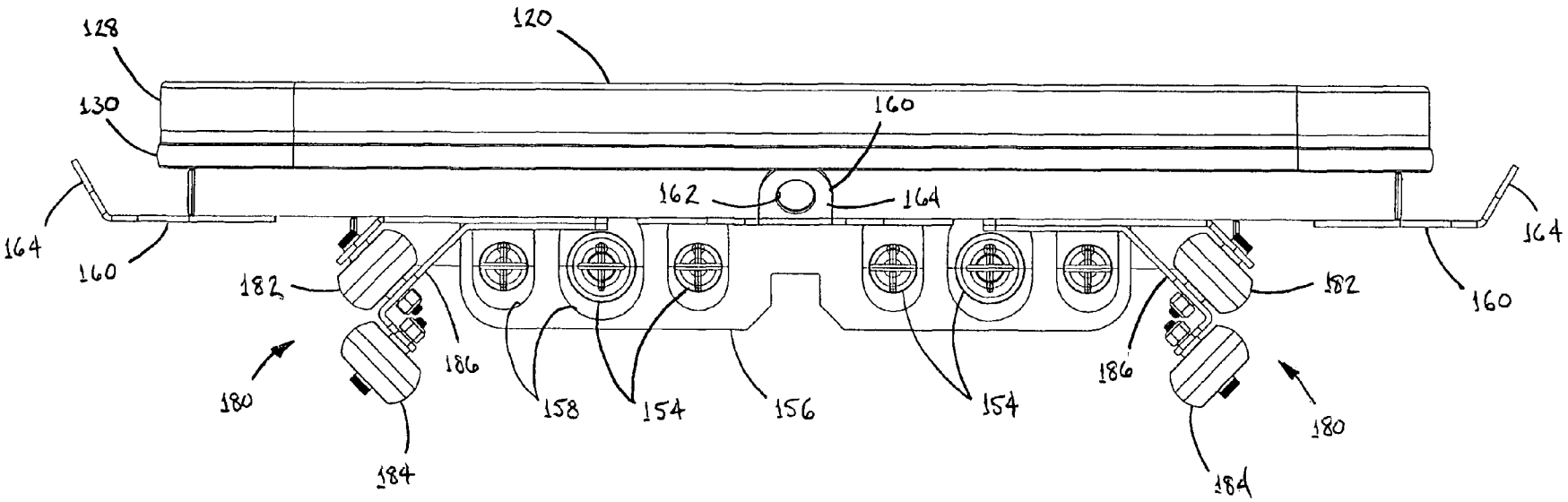
FIG. 12 is an end elevational view of the carriage assembly of FIGS. 9-11, showing the roller assemblies and their relationship to the platform of the carriage assembly in greater detail.

To establish rolling engagement with the rails of the frame assembly, wheel assemblies 180 are mounted proximate each corner of platform 120. As can be seen in FIG. 11 and also FIG. 10, each of the wheel assemblies 180 includes upper and lower wheels 182, 184, the latter preferably being in pairs to better support the weight of the platform and user, the upper and lower wheels being angled towards one another towards the outboard (lateral) sides of the platform as shown in FIG. 12, preferably at an angle of about 90° so as to engage the cooperating medial surfaces of the rails substantially normal thereto.

Figure 13:
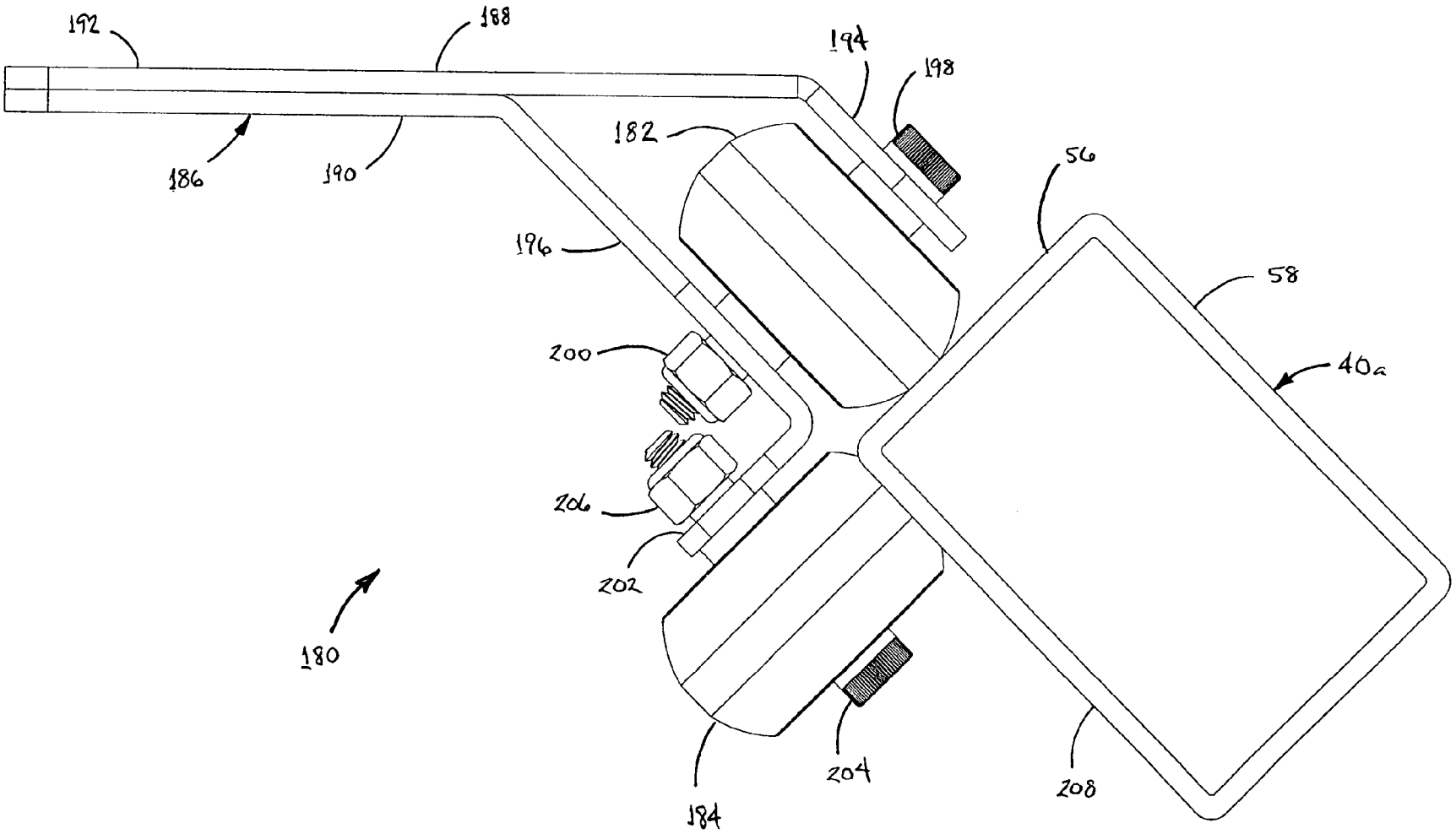
FIG. 13 is an enlarged elevational view of one of the roller assemblies of the carriage assembly of FIGS. 9-12, showing the manner in which the roller assembly operatingly engages an associated rail of the frame assembly, the rail being shown in cross-section.

In the preferred embodiment that is illustrated, the upper and lower wheels 182, 184 of the assemblies 180 are mounted on brackets 186 that are in turn mounted to the underframe of the platform 120, suitably on the cross-members 142, 144 as shown in FIG. 10. As can be seen in FIG. 13, each of the brackets 186 is constructed of upper and lower plates 188, 190 that lie flat together to form a horizontal base portion 192 by which the bracket is mounted to the underframe, but which diverge towards the distal end of the bracket to provide attachment points for the wheels. In particular, as can be seen with further reference to FIG. 13, the upper plate 188 extends horizontally to a bend from which it extends downwardly and outwardly at an angle about 45°, to form a mounting flange 194 that lies in a plane generally parallel to that of the sloped outer surface 58 of the associated rail 40*a*, 40*b*. The lower plate 190 also extends downwardly from a 45° bend to form a second mounting flange 196, but at a spaced distance inwardly from the first mounting flange 194 so as to form a gap sized to receive wheels 182 edgewise therein. Bolts 198 pass through cooperating bores formed perpendicularly through flanges 194, 196 to provide load bearing axles for the upper set of wheels 182, and are secured by nuts 200. The distal portion of lower plate 190, below flange 196, extends through a reverse bend of about 90° to form an end mounting flange 202 having a cooperating perpendicular bore (not shown) through which bolt 204 passes and is secured by nut 206, to form a load bearing axle for the lower wheel 184 of the assembly. Thus assembled and mounted to the bottom of the platform in the manner described, the wheel assemblies engage both the downwardly sloped upper medial walls 56 of the rails 40*a*, 40*b* and the upwardly sloped lower medial walls 208 that extend parallel to walls 58. The combination of angled wheels and sloped surfaces insures effective transmission of both vertical and lateral loads from the platform assembly to the rails of the frame assembly, with this being accomplished using inexpensive "off-the-shelf" rectangular tubing for the rails rather than requiring specialized extrusions, tracks, etc. Moreover, upper and lower wheels cooperate with the sloped surfaces of the rails, which in essence form a taper towards the wheels and the longitudinal centerline of the frame, to provide a gentle self-centering action that maintains the platform assembly in alignment with the frame without abrupt changes in direction or unpleasant "slamming". In addition, the lateral spacing between wheel assemblies on opposite sides of the platform is such that the engagement between the angled wheels and the "corners" formed between the angled surfaces 56, 208 also captures and holds the platform against rocking or other vertical movement relative to the frame during use. The wheels are preferably formed of a material having low rolling resistance and good durability combined with a slight degree of resilience, such as urethane or synthetic rubber, for example, with suitable wheel units being available from numerous commercial sources.

In order to conveniently install the platform assembly including wheel assemblies 180 on the frame 12 of the machine, the platform can first be rolled endwise onto one of the two frame sections 50, 52 while they are separated, and the two frame sections then join together in the manner previously described so that the wheel assemblies are captured between the assembled rails 40*a*, 40*b*.

d. Adjustable Arm Assemblies

Adjustable arm assemblies 16 and 18 will be described in greater detail with reference to FIGS. 14-30*b*. The two bar assemblies are similar in many respects, a principal difference being the foot end bar assembly of the illustrated embodiment is adjustable between different positions about a horizontal axis relative to the frame of the machine.

Figure 14:
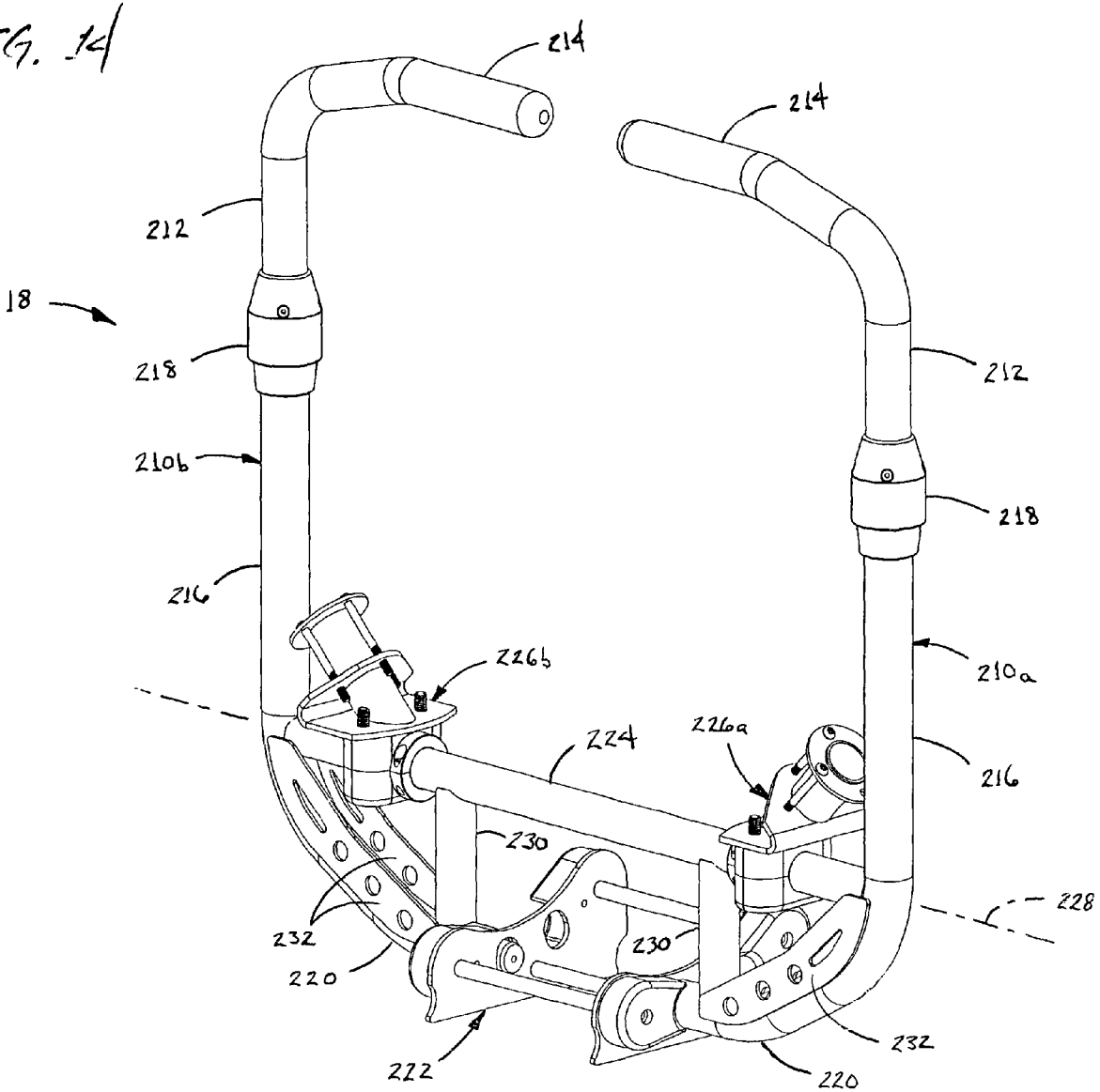
FIG. 14 is a perspective view of the first adjustable bar assembly of the exercise machine of FIGS. 1-5, that is located proximate the foot end of the machine.

As can be seen in FIG. 14, the foot-end adjustable bar assembly 18 includes first and second bar members 210*a*, 210*b* that extend in generally vertical, parallel relationship on opposite sides of the exercise machine, outboard of the two rails 40*a*, 40*b*. Each of the bar members includes an upper segment 212 that transitions through a bend of approximately 90° to form a substantially horizontal handle portion 214 at the end thereof, the bar segments preferably being formed of tubular steel, aluminum, composite or other material having a diameter suitable to be gripped comfortably in the user's hands. The upper bar segments 212 are coaxially joined to lower bar segments 216 by castellated couplings 218, the use of which will be described below. The lower arm sections 216 are preferably likewise tubular in cross-section, and extend through 90° bends to form inwardly directed lower end portions 220 that engage a lock assembly 222 that is mounted to the frame. A horizontal cross tube 224 spans the leg segments 216, proximate the junction with the inwardly bent lower sections 220, and is supported from the frame by first and second pivot assemblies 226*a*, 226*b* to permit rotation of the interconnected arm members 210*a*, 210*b* about a horizontal axis 228. First and second tube segments 230 extend between the horizontal cross tube 224 and the inwardly extending bar ends 220, and the strength/rigidity of the lower part of the assembly is further enhanced by gusset plates 232 welded along the sides of the inwardly bent sections 220 and the adjacent ends of the tubes 224, 230.

Figure 15:
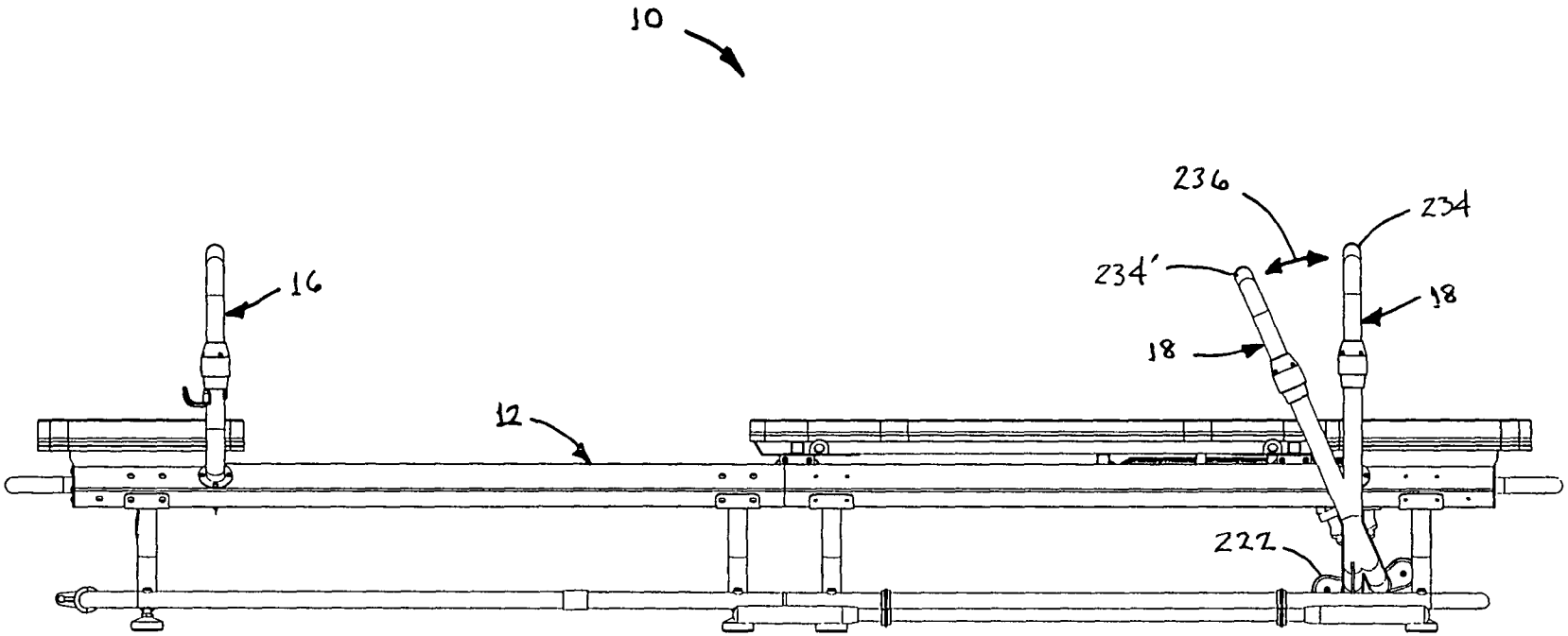
FIG. 15 is a side elevational view of the exercise machine of FIGS. 1-5, showing the manner in which the bar assembly of FIG. 14 is selectively adjustable about a horizontal axis between different angular positions relative to the main plane of the machine.

The rotational axis 228 established by cross tube 224 and cooperating pivot assemblies 226*a*, 226*b* enables the bar assembly to be pivoted between alternate positions 234, 234' as indicated by double-headed arrow 236 in FIG. 15; in the illustrated embodiment, the first position is preferably with the bar segments being vertical and the second position with the bar segments angled towards the head end of the machine.

Figure 16:
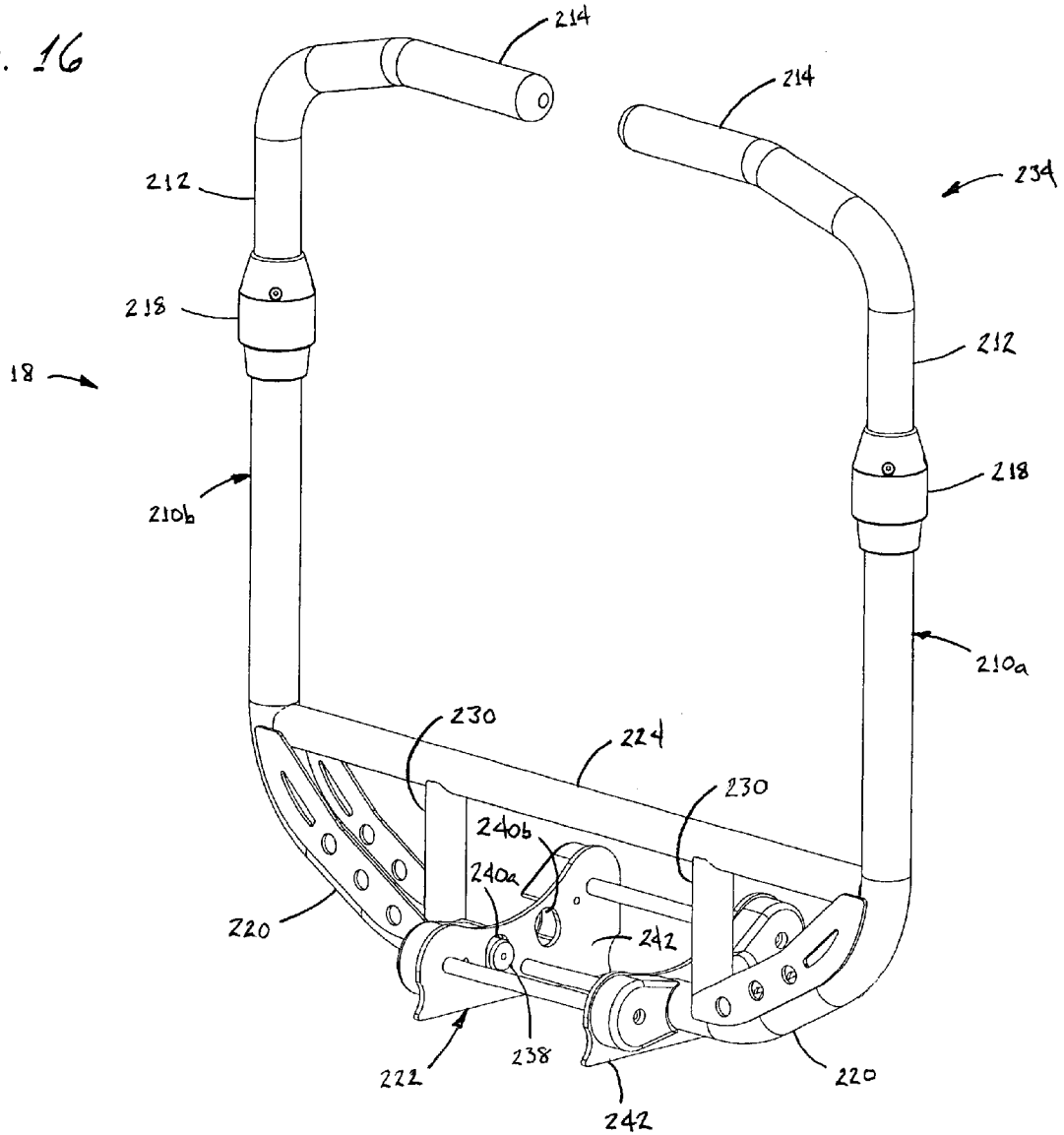
FIG. 16 is a perspective view of the foot-end bar assembly of FIG. 14, with certain supports being deleted for clarity, showing the bar assembly in the first angular position of FIG. 15.
Figure 17:
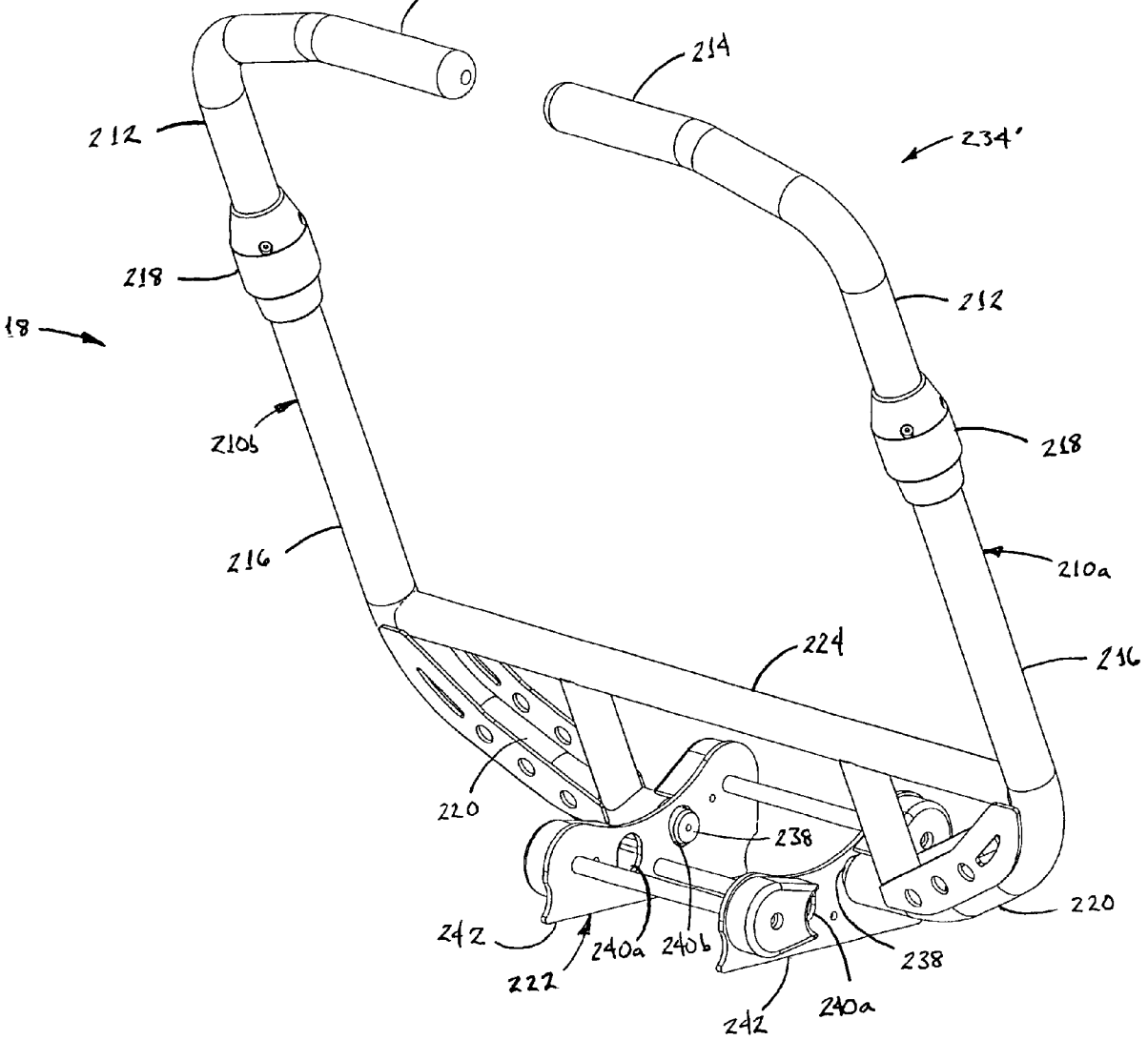
FIG. 17 is a perspective view of the bar assembly of FIG. 14, similar to FIG. 16, showing the bar assembly in the second angular position of FIG. 15.
Figure 21:
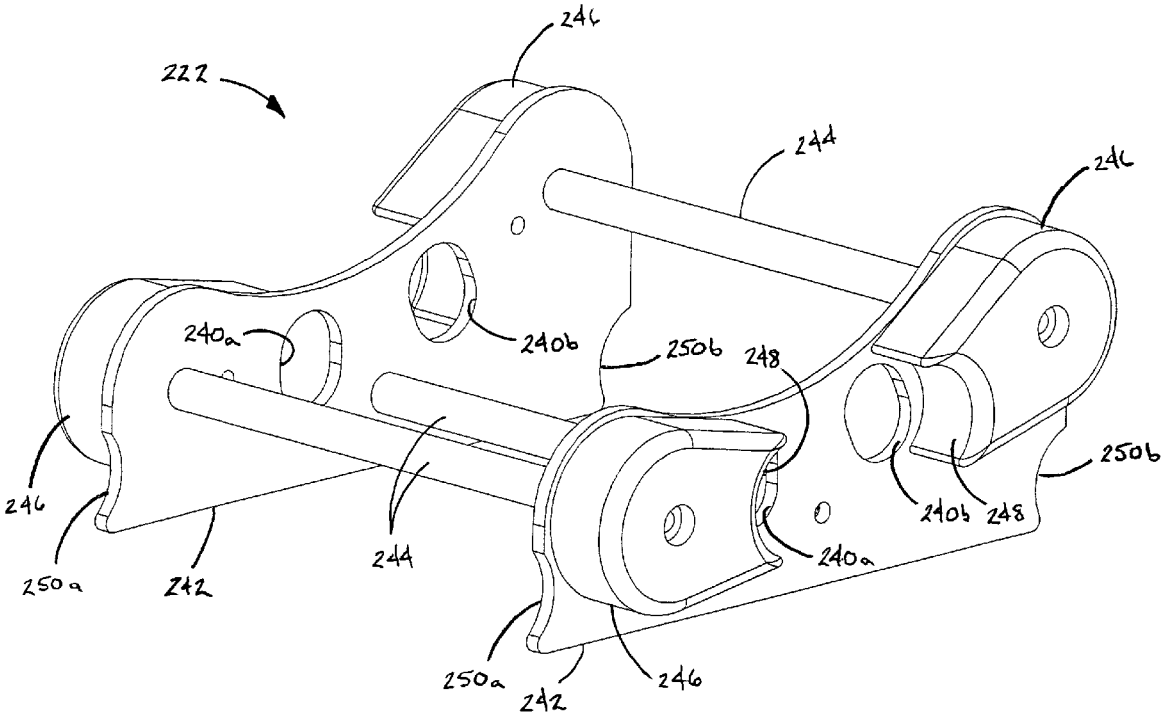
FIG. 21 is a perspective view of the locking plate portion of the foot-end bar assembly of FIGS. 14-20, showing the openings that are engaged by the plunger extended from the arms of the bar assembly when in the locked configuration of FIG. 19.

At each position the bars are locked in position by engagement with the locking assembly 222. As can be seen in FIGS. 16 and 17, retractable plungers 238 extend from the ends of the inwardly-directed tubular bar sections 220 to engage cooperating openings 240*a*, 240*b* in parallel side plates 242 of the lock assembly 222. As can be seen in FIG. 21, the openings 240*a*, 240*b* are formed in coaxial pairs in the two side plates 242 of the locking assembly 222. The side plates 242 are maintained in parallel, spaced apart relationship by transverse spacer rods 244, to which the side plates are suitably mounted by machine screws or similar fasteners. Block members 246 are mounted in pairs on the outboard sides of the plate members 242 with openings 240*a*, 240*b* between them, the block members each having generally concave stop surfaces 248 that are located proximate the adjacent opening 240*a*, 240*b* and contoured to react against the inwardly turned end 220 of the tubular bar member so as to arrest it with the plunger 238 therein in register with the corresponding opening in the locking assembly. The block members 246 are preferably formed of a stiff but somewhat resiliently-yielding material, such as hard rubber or urethane for example, so as to effectively arrest the ends of the bar members but with a cushioned effect that avoids undesirable banging or jarring. The side plates 242 of the locking assembly further include concave notches 250*a*, 250*b*, that allow the locking assembly to be mounted between the cross tubes 60*b*, 72 of the frame as shown in FIG. 8.

Therefore, by withdrawing the plungers 238 into the ends of their respective tube ends 220, the bar assembly is freed from engagement with the locking assembly so as to be pivotable about the horizontal axis, as indicated by arrow 236 in FIG. 15. When the desired position is reached, pivoting motion of the bar assembly is arrested by the stop surfaces of the block members 246, and the plungers 238 are extended into the associated set of openings 240*a*, 240*b* to reestablish engagement with the locking assembly and thereby hold the bar assembly in position.

Figure 18:
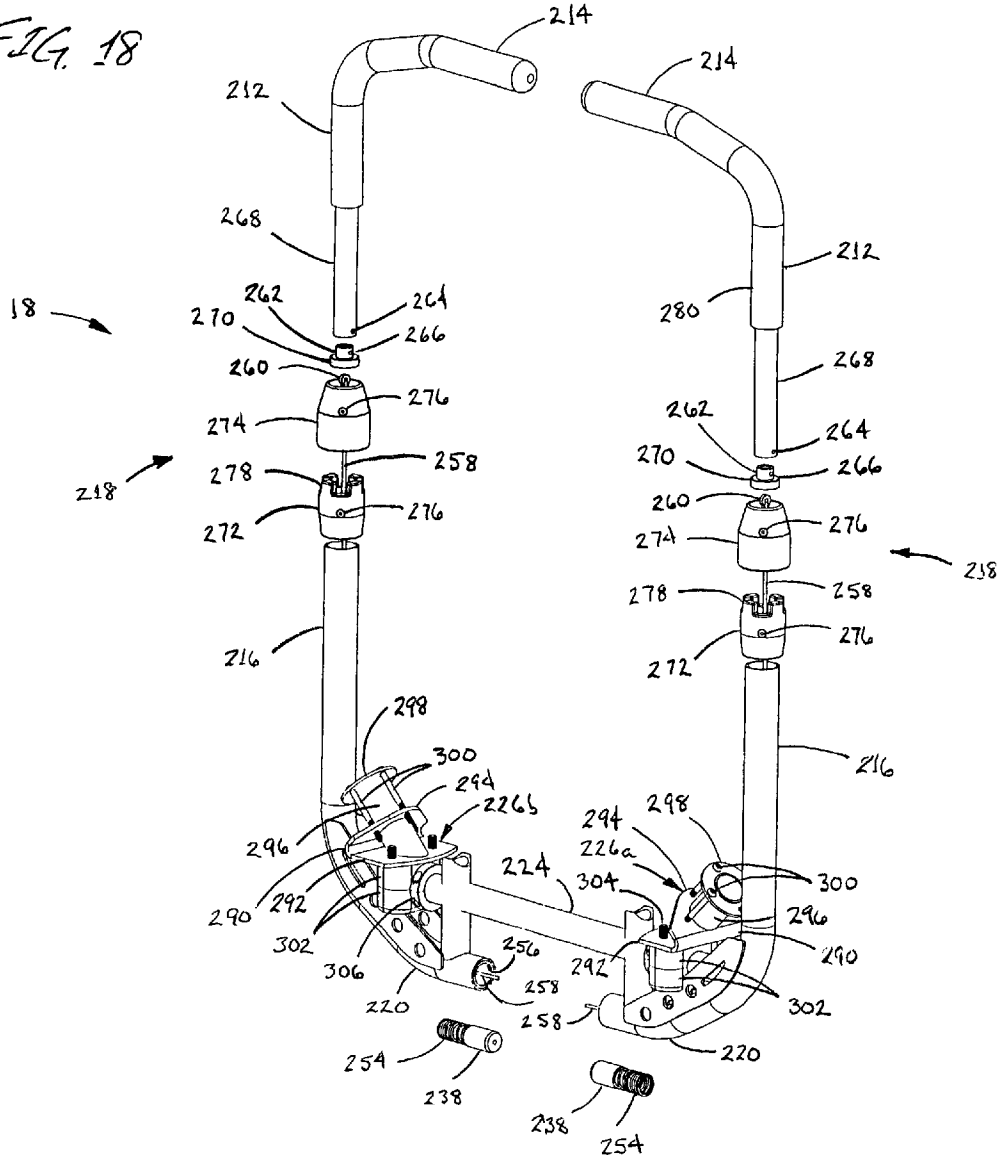
FIG. 18 is a partially exploded view of the bar assembly of FIG. 14, showing the components thereof in greater detail.

The mechanism that enables selective withdrawal and extension of the locking plungers 238 is shown in the exploded view of FIG. 18. As can be seen therein, the retractable plungers 238 are backed by coil springs 254, that react against shoulders (not shown) set within the respective tube ends 256 so as to bias the plungers towards the extended position. Each of the plungers is attached to an end of a flexible cable 258, that extends through the associated tubular lower bar segment 216 to a second, upper end having a connector eye 260 or other attachment fitting thereon. The upper end fittings of the cables are received in axial openings in hat-shaped end plugs 262 that are in turn set within hollow lower ends of the upper bar segments 212, the cable end fitting and plug being joined to the bar end by a pin (not shown) that passes through cooperating bores 264, 266 in the tube, the plug and the eye of the end fitting.

Figure 19:
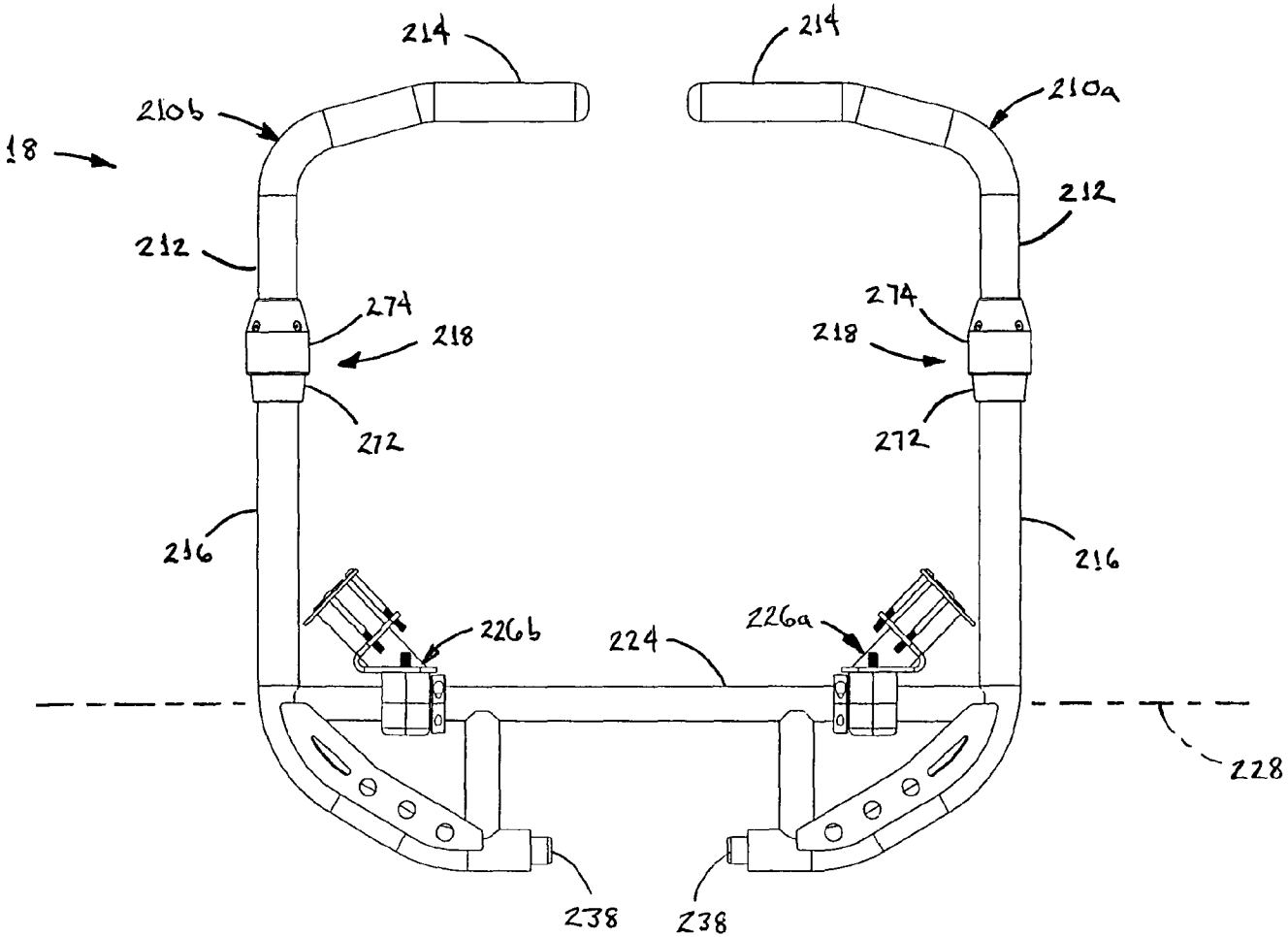
FIG. 19 is a first end elevational view of the foot-end bar assembly of FIGS. 14 and 18, showing the bar assembly in a first configuration in which the upper bar ends are lowered so that plunger members extend from the assembly so as to lock it in a selected angular position.
Figure 20:
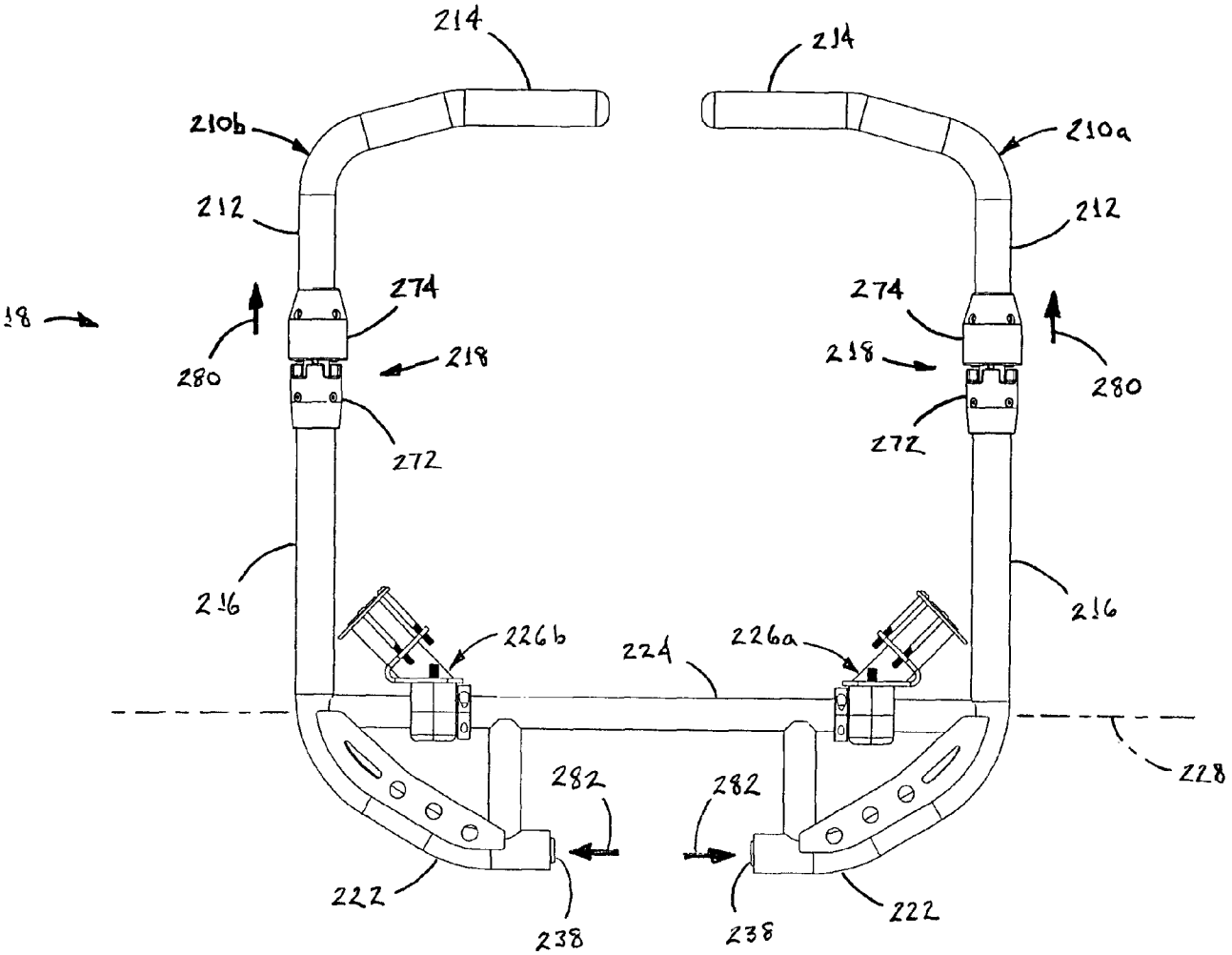
FIG. 20 is a second end elevational view of the foot-end bar assembly, similar to FIG. 19, showing the assembly in a second configuration in which the upper bar ends are raised so that the plunger members are retraced so as to unlock the assembly to allow it to be pivoted between angular positions.

The lower leg portions 268 of the upper bar members 212 and the flanges 270 of end plugs 262 have diameters sized to be telescopingly received in the tubular lower bar segments 216, forming a smooth and stable vertical sliding interfit between the upper and lower bar segments. Cables 258 therefore form a connection between the locking plungers 238 and upper bar members 212, the lower ends of the latter being telescopingly received in the lower bar members 216 (it will be understood that for ease of understanding the length of cable 258 is shown exaggerated in FIG. 18). Lower and upper castellated coupling members 272, 274 are mounted to the lower and upper bar members respectively, by set screws 276, the lower castellated member having a plurality of upwardly projecting teeth 278 and notches, that engage corresponding teeth and notches (not shown) set within the tubular interior of the upper castellated member. The upper members 274 of the couplings are mounted to the tubular legs 268, proximate a junction between the exposed tubular material of the upper bar members 212 and a layer of cushioning material 280 that covers the upper ends 214 of the bar members to provide an enhanced, comfortable grip for the user. The distance by which the lower legs 268 of the upper bar members extend downwardly from the couplings 218 into the lower bar members 216 is selected relative to the length of the cables 258 such that when lowered the plunger members 238 will project from the ends of their respective tube sections 220 a sufficient distance to engage the openings 240*a*, 240*b* of the locking assembly, for example as shown in FIG. 19. Then, to unlock the bar assembly so that it can be pivoted to an alternative position, the operator pulls upwardly on the upper bar segments 212, as indicated by arrow 280 in FIG. 20, applying tension via the cable 258 to withdraw the plunger members 238 from the openings in the locking plate and into the ends of tube sections 222, as indicated by arrows 282, thus freeing the bar assembly 18 to be pivoted about horizontal axis 228 in the manner previously described. Raising the upper bar members 212 in an amount sufficient to fully disengage the castellated nut members 272, 274 also decouples the upper bar members from the lower bar members 216 so as to permit the former to be pivoted about the longitudinal axis (vertical) to alternate positions, as will be described in greater detail below.

In addition to the locking mechanism described above, FIG. 18 also shows the structure of the pivot supports 226*a*, 226*b* that enable the bar assembly to pivot about horizontal axis 228 when disengaged from the locking assembly. As can be seen therein, each of the support assemblies includes a generally V-shaped (in end view) bracket 290 having a generally horizontal lower flange 292 and an upper flange 294 that extends inwardly and upwardly at an angle that corresponds to that of the lower medial surface 208 of the rail member (see FIG. 13), i.e., approximately 45° to horizontal in the illustrated embodiment. An upwardly and outwardly angled stub tube 296 passes perpendicularly through upper flange 294, with a sliding ring-shaped clamp plate 298 fitting annularly around the distal end of the stub tube at a spaced distance from and generally parallel to the angled flange. The outside diameter of the stub tubes 296 corresponds to the diameter of the circular openings 100 formed through the rails of the frame assembly (see FIG. 8), with the length of the stub tubes being such that the distance between the angled flanges 294 and ring-shaped clamp plates 298 corresponds to the thickness of the rails between surfaces 58 and 208. The support assemblies 226*a*, 226*b* are therefore mounted to the rails 40*a*, 40*b* of the frame assembly by inserting the stub tubes through openings 100 from beneath the rails so as to bring the angled flanges 294 into face-to-face engagement with the inner lower medial surfaces 208, then placing the clamp rings 298 around the ends of the stub tubes so that they lie in face-to-face engagement with the upper lateral rail surfaces 58, then installing bolts 300 through bores 102 and cooperating bores in the clamp plate and flange 294 and tightening so as to firmly clamp the support assemblies to the rail members.

As can be seen with further reference to FIG. 18, a pair of bearing blocks 302 is clamped around the cross-tube 224 of the bar assembly, against the bottom sides of the horizontal lower flanges 292 of brackets 290, by bolts 304. The pair of blocks have facing semi-cylindrical channels that cooperate to form bearing surface against the cylindrical exterior of cross-tube 224; the bearing blocks are preferably formed of a durable, high strength, low friction material, such as UHMWPE or nylon, for example. Annular collars 306 are clamped around tube 224 inboard of each of the bearing assemblies formed by blocks 302, to limit movement of the bar assembly in a lateral direction relative to the support assemblies 226*a*, 226*b*.

The support assemblies 226*a*, 226*b* thus interconnect the bar assembly 18 and the frame of the exercise machine, the cross-tube 224 and bearing blocks 302 cooperating to form the horizontal pivot axis 228. Loads imparted to the bar assembly are effectively transferred into the frame by the engagement formed by flanges 294, stub tubes 296 and clamping plates 298.

Figure 22:
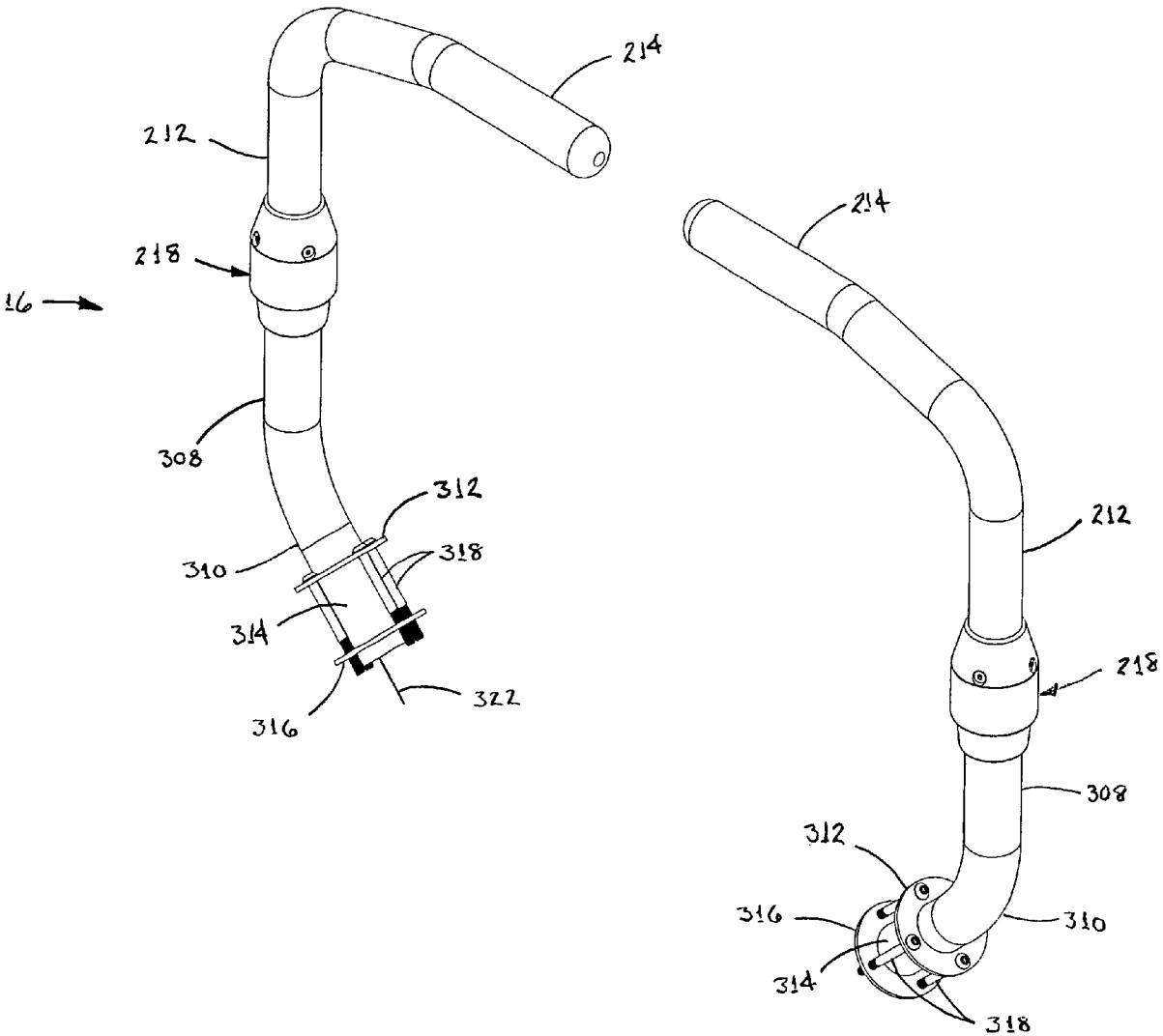
FIG. 22 is a perspective view of the second adjustable bar assembly of the exercise machine of FIGS. 1-5, that is located proximate the head end of the machine.
Figure 23:
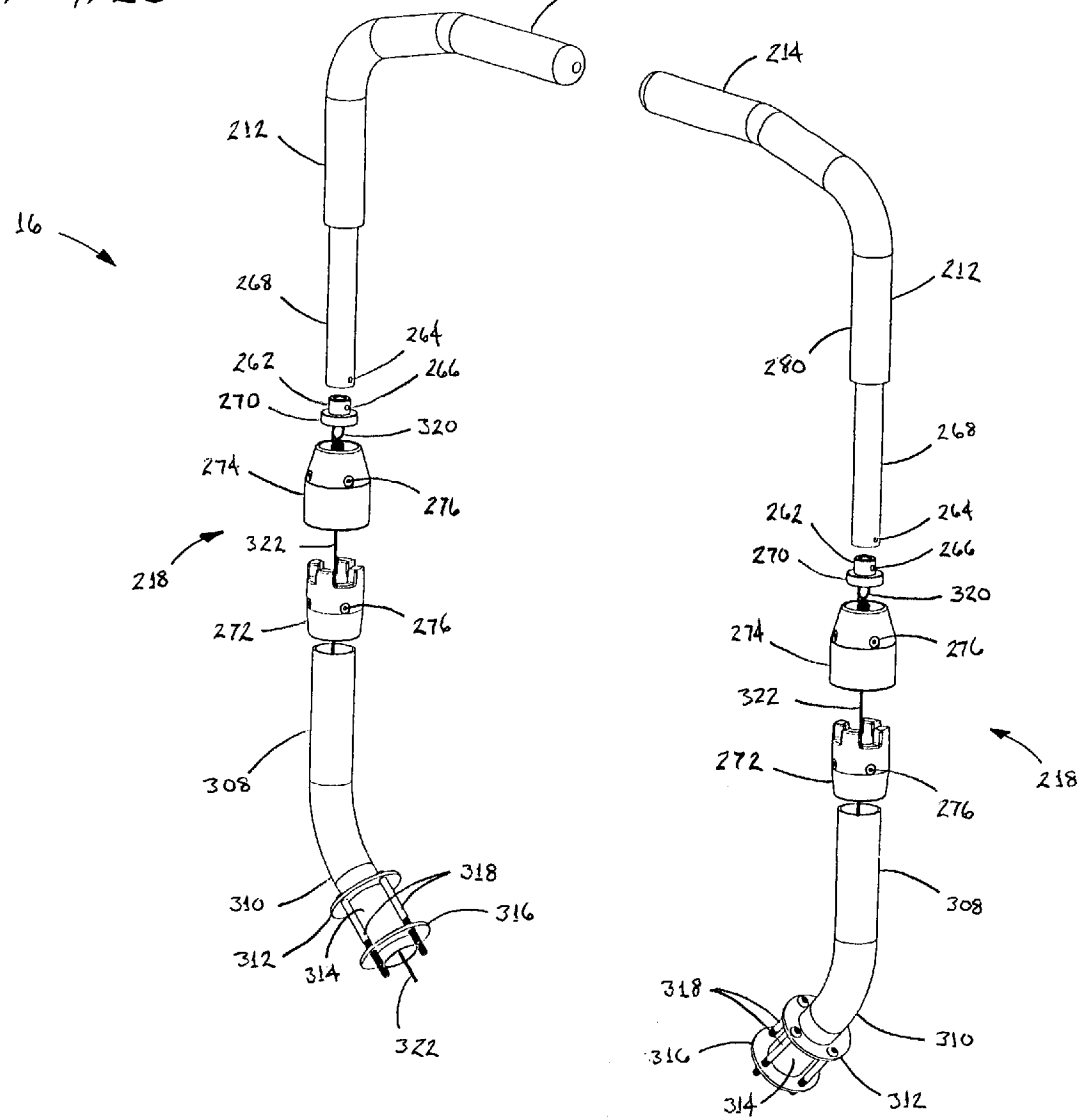
FIG. 23 is a partial, exploded view of the head-end bar assembly of FIG. 22, showing the components thereof in greater detail.
Figure 24A:
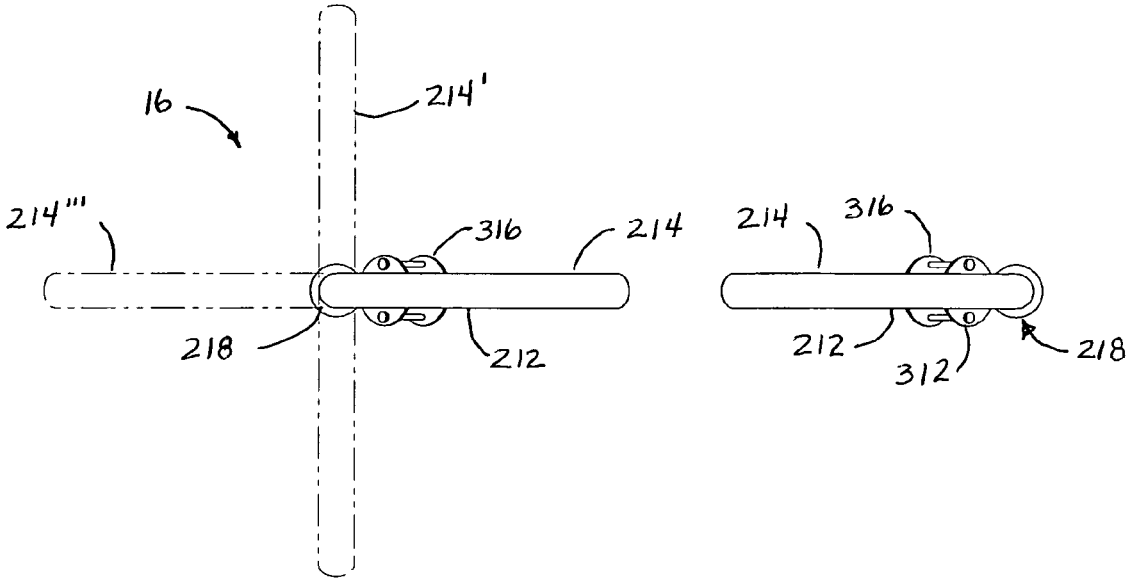
FIGS. 24A and 24B are, respectively, top plan and end elevational views of the bar assembly FIGS. 22-23, showing the manner in which the upper bar members thereof are selectively adjustable by being rotated to different angular orientations in a generally horizontal plane, the upper bar portions of the foot-end bar assembly being similarly adjustable.
Figure 24B:
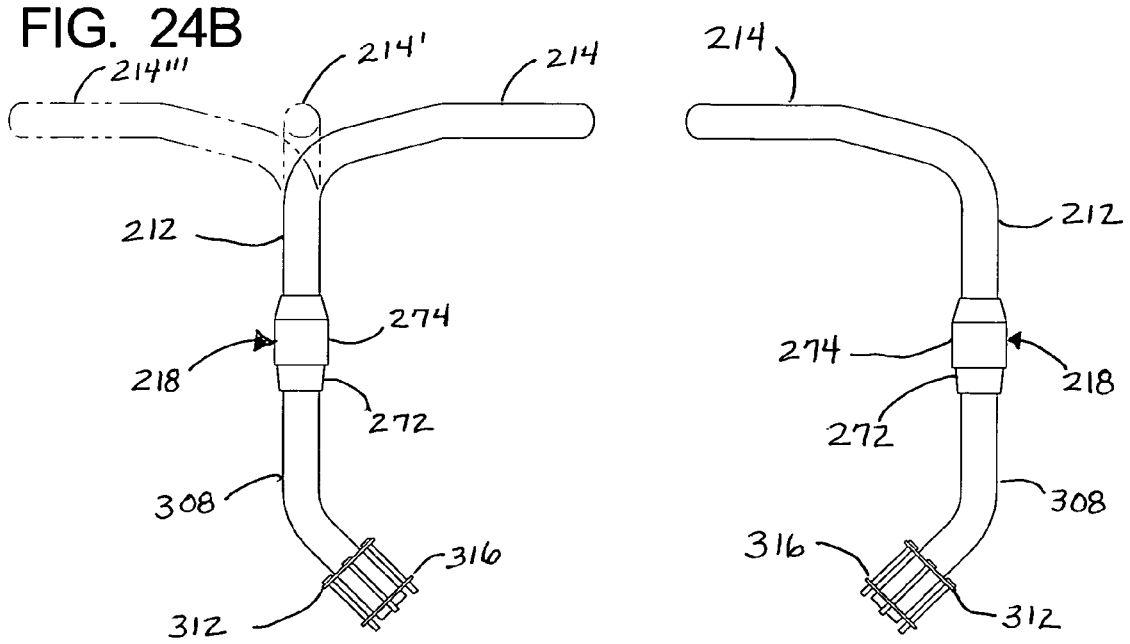

While the identical bar assemblies may be mounted at both ends of the exercise machine, in the preferred embodiment that is illustrated the head-on bar assembly 16 is somewhat simplified by comparison with the foot-end bar assembly 18 in lacking the horizontal pivot axis mechanism. Thus, as can be seen in FIGS. 22-23, the upper bar segments and coupling assemblies are substantially identical to those of the foot-end bar assembly described above, and are therefore identified by like reference numerals. The tubular lower bar segments 308 are also generally similar to the corresponding members 216 described above, in having straight upper portions that receive the lower legs 268 of the upper bar segments in telescoping relationship and to which the lower castellated nut members 272 of the couplings 218 are mounted, however the lower sections 310 are relatively shortened and extend through a bend of about 45° only so that their lower ends are perpendicular to the upper lateral sloped surfaces 58 of rails 40*a*, 40*b*. Annular flanges 312 are welded or otherwise fixedly mounted around the lower sections 310 a spaced distance from the ends thereof, so as to define short segments 314 projecting distally of the flanges that correspond to the stub tubes 296 described above. Annular clamping plates 316, corresponding to the clamping plates 298 of the foot-end support assemblies, slip-fit over the ends of the tube segments 314, with bolts 318 passing through cooperating bores in the clamping plates and fixed flanges 312. The bar members of the head end assembly 16 consequently mount to the rails 40*a*, 40*b* using openings 100 and bolt holes 102 in a manner similar to the support assemblies of the foot-end bar assembly, but with the stub segments 314 being inserted through the openings from above the rails rather than below, and the ring-shaped plates 316 being installed against the bottom surfaces 208 of the rails and the bolts then tightened to clamp the bar members in place.

Coil tension springs 320 are mounted to the plug members 262 in the ends of the leg sections 268 of the upper bar members, by pins (not shown) that pass through bores 264 and 268 in the leg sections and plug members and through cooperating eyes at the upper ends of the springs. The lower ends of the springs are in turn connected to flexible cables 322 (the lengths of which are again exaggerated in the drawing for ease of understanding) that are fed through the tubular lower bar members 308 and out the open bottoms thereof, where they are attached to an anchor formed by one of the bolts or other stationary fitting on the undersides of the rails. The tension exerted by springs 320 thus biases the lower and upper castellated nut members of couplings 218 into engagement so as to lock the upper and lower bar segments against rotation, but allows an operator to lift the upper leg segments when desired so as to raise the upper castellated members out of engagement with the lower members and thereby free the upper leg members to be adjusted to alternate orientations.

In the illustrated embodiment, the castellated members of couplings 218 each having four cooperating teeth/notches set at 90° intervals, so that the user is able to adjust the upper ends 214 of the upper bar members from their inwardly directed orientations 90° toward the head-end or foot-end as indicated at 214' and 214", or 180° outwardly so that the upper bar ends project laterally from the sides of the machine as indicated at 214'''. The adjustments are accomplished by simply lifting the upper bar member so as to raise the upper coupling member 274 out of engagement with the lower member 272, rotating the bar members 214 about its vertical axis relative to the stationary lower bar member until the desired orientation is reached, and then releasing the upper bar member so that the spring tension draws the coupling members together so as to lock the upper bar member in its new orientation. It will be understood that the coupling members may be configured to allow adjustment of the upper bar members to a greater or lesser number of positions than the four provided in the illustrated embodiment, and moreover that the couplings may employ other or additional mechanisms than the tooth and notch mechanism that is illustrated, such as gear or friction-action couplings, for example.

The adjustable bar assemblies 16, 18, in combination with the other elements of the machine, make a great variety of exercises available to the user, developing muscle groups in targeted fashions not generally feasible with prior machines. FIGS. 29A-30B provide several examples of the many different exercises possible with the bar assemblies adjusted to different positions.

Figure 25A:
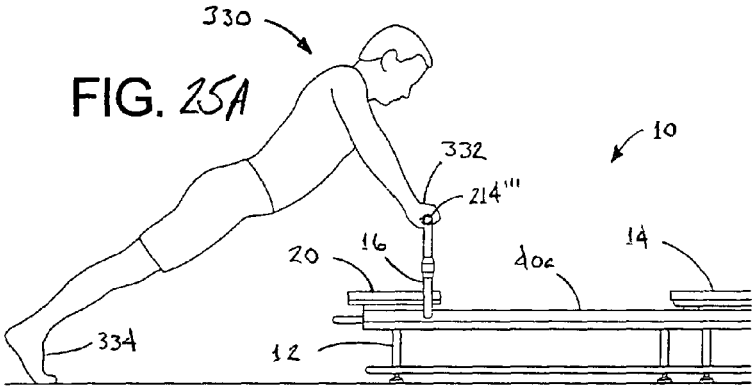
FIGS. 25A and 25B are, respectively, side elevational and top plan views of an individual performing an exemplary exercise on the machine of FIGS. 1-5, using the upper bar portions of the head-end bar assembly rotated to the angular positions shown in FIG. 25B.
Figure 25B:
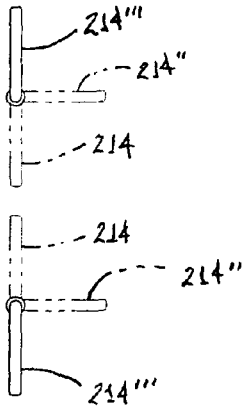
Figure 26A:
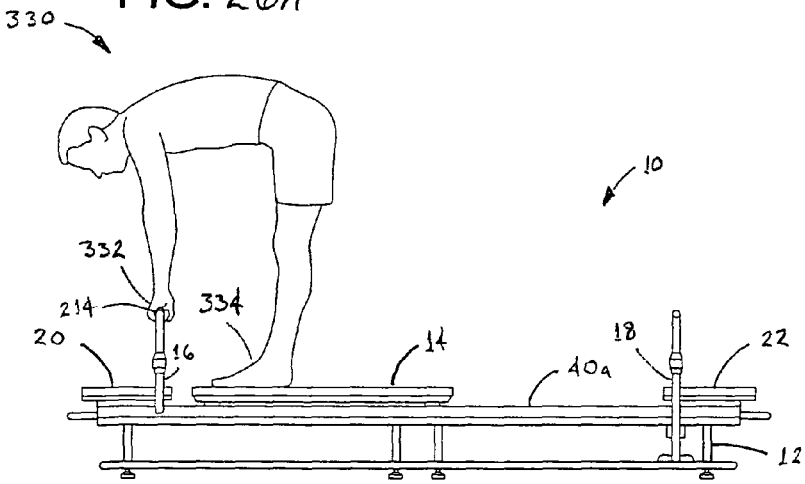
FIGS. 26A and 26B are, respectively, side elevational and top plan views of an individual performing an exemplary exercise on the machine of FIGS. 1-5, using the upper bar portions of the head-end bar assembly rotated to the angular positions shown in FIG. 26B.
Figure 26B:
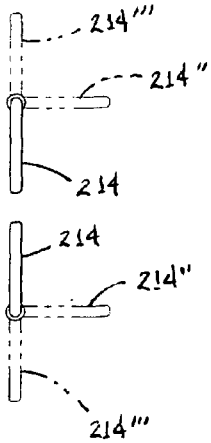
Figure 27A:
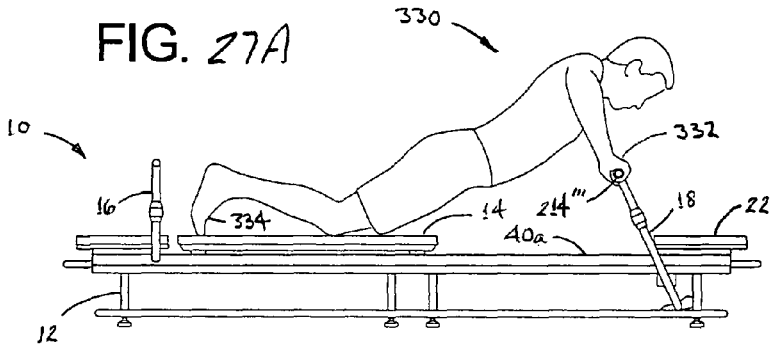
FIGS. 27A and 27B are, respectively, side elevational and top plan views of an individual performing an exemplary exercise on the machine of FIGS. 1-5, using the upper bar portions of the foot-end bar assembly rotated to the angular positions shown in FIG. 27B.
Figure 27B:
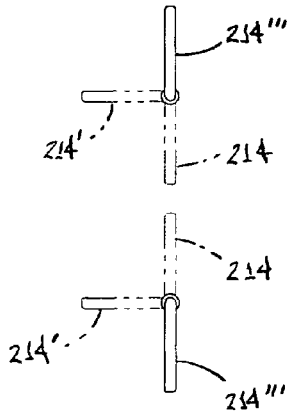
Figure 28A:
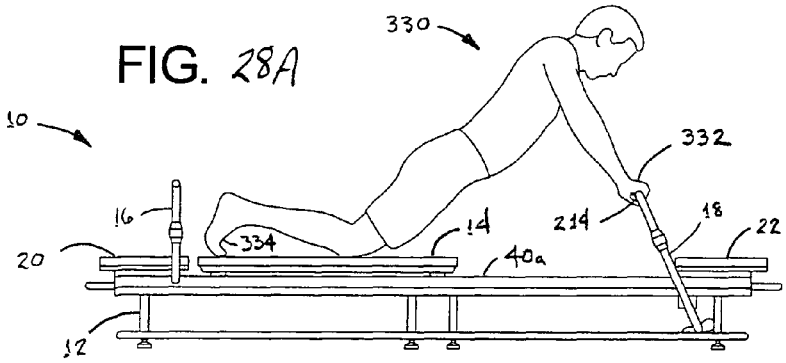
FIGS. 28A and 28B are, respectively, side elevational and top plan views of an individual performing an exemplary exercise on the machine of FIGS. 1-5, using the upper bar portions of the foot-end bar assembly rotated to the angular positions shown in FIG. 28B.
Figure 28B:
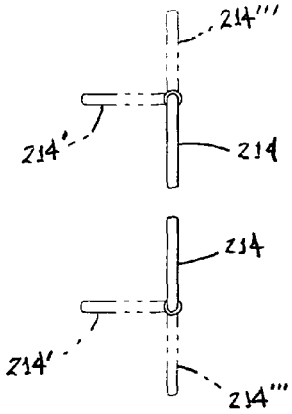
Figure 29A:
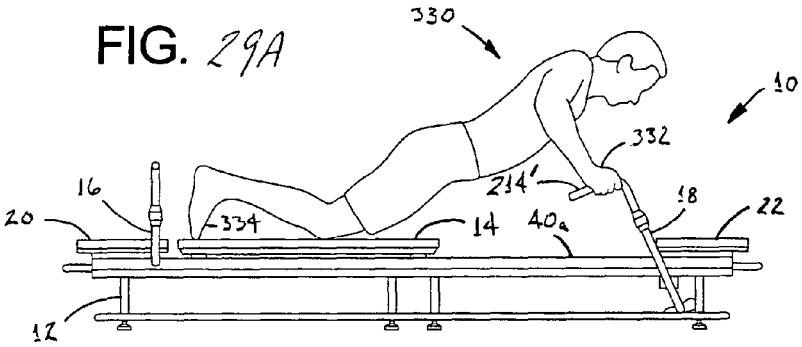
FIGS. 29A and 29B are, respectively, side elevational and top plan views of an individual performing an exemplary exercise on the machine of FIGS. 1-5, using the upper bar portions of the foot-end bar assembly rotated to the angular positions shown in FIG. 29B.
Figure 29B:
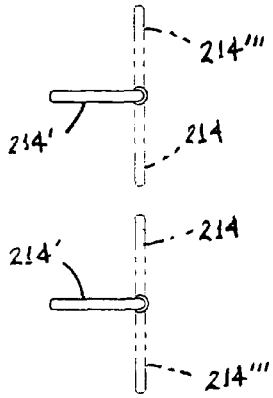
Figure 30A:
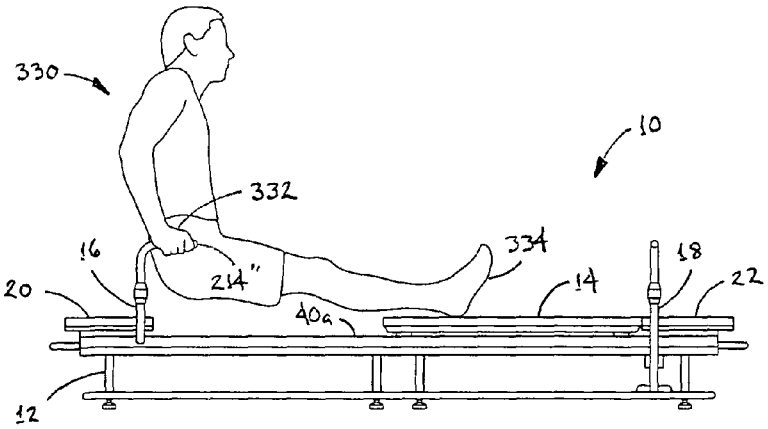
FIGS. 30A and 30B are, respectively, side elevational and top plan views of an individual performing an exemplary exercise on the machine of FIGS. 1-5, using the upper bar portions of the head-end bar assembly rotated to the angular positions shown in FIG. 30B.
Figure 30B:
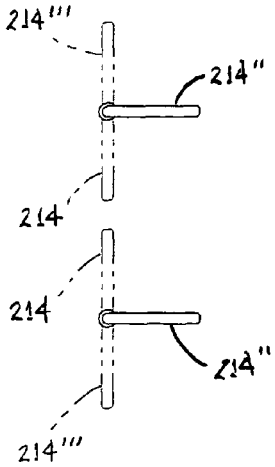

In the example shown in FIGS. 25A-25B, the upper bar members of the head-end assembly 16 are rotated to their outwardly directed, divergent orientation, as indicated at 214'''; in one exercise performed with the bars in this position, the user 330 grasps the out-turned bars in his hands 332, and with his feet positioned completely off the head end of the machine performs a series of pushup-like repetitions. In another example, the upper members of the head-end bar assembly turn inwardly so as to extend towards one another as indicated at 214 in FIGS. 26A-26B, and the user stands on the platform 14 and leans over to grasp the bar ends in his hands 332, and extends and re-doubles his body in a series of repetitions drawing the platform 14 towards the head end of the machine against the resistance offered by the tension springs. FIGS. 27A-27B show the foot-end bar assembly adjusted about the horizontal axis to be angled towards the head end of the machine and the upper bar members adjusted to their outwardly directed positions as indicated at 214''', and an example exercise in which the user grips the spread-apart bar ends and inserts the toes of his feet in the platform openings 30*a*, 30*b* (see FIG. 9) and performs repetitions pushing the platform towards the head end of the machine against resistance of the springs. FIGS. 28A-28B show the user similarly positioned but with the upper bar members rotated to their inwardly directed orientations as indicated at 214, and the user performing a series of pushup repetitions while holding the platform in position against the tension exerted by the springs. FIGS. 29A-29B shown an exercise similar to that in FIGS. 27A-27B, but with the bar members rotated parallel to the rails as indicated at 214', so as to exercise a somewhat different muscle group. In FIGS. 30A-30B, the upper members of the head-end bar assembly 16 are also oriented to extend parallel to the frame rails, as indicated at 214", with the user grasping the bar ends while facing the foot end of the machine with his heels resting on platform 14, and performing repetitions lowering and raising his posterior in the gap between the moving platform and the stationary head-end platform 20.

As noted above, it will be understood that the foregoing are only a few examples of the many possible exercises that may be performed with the adjustable bar assemblies in their various positions.

e. Retractable Shoulder Pads

Figure 31:
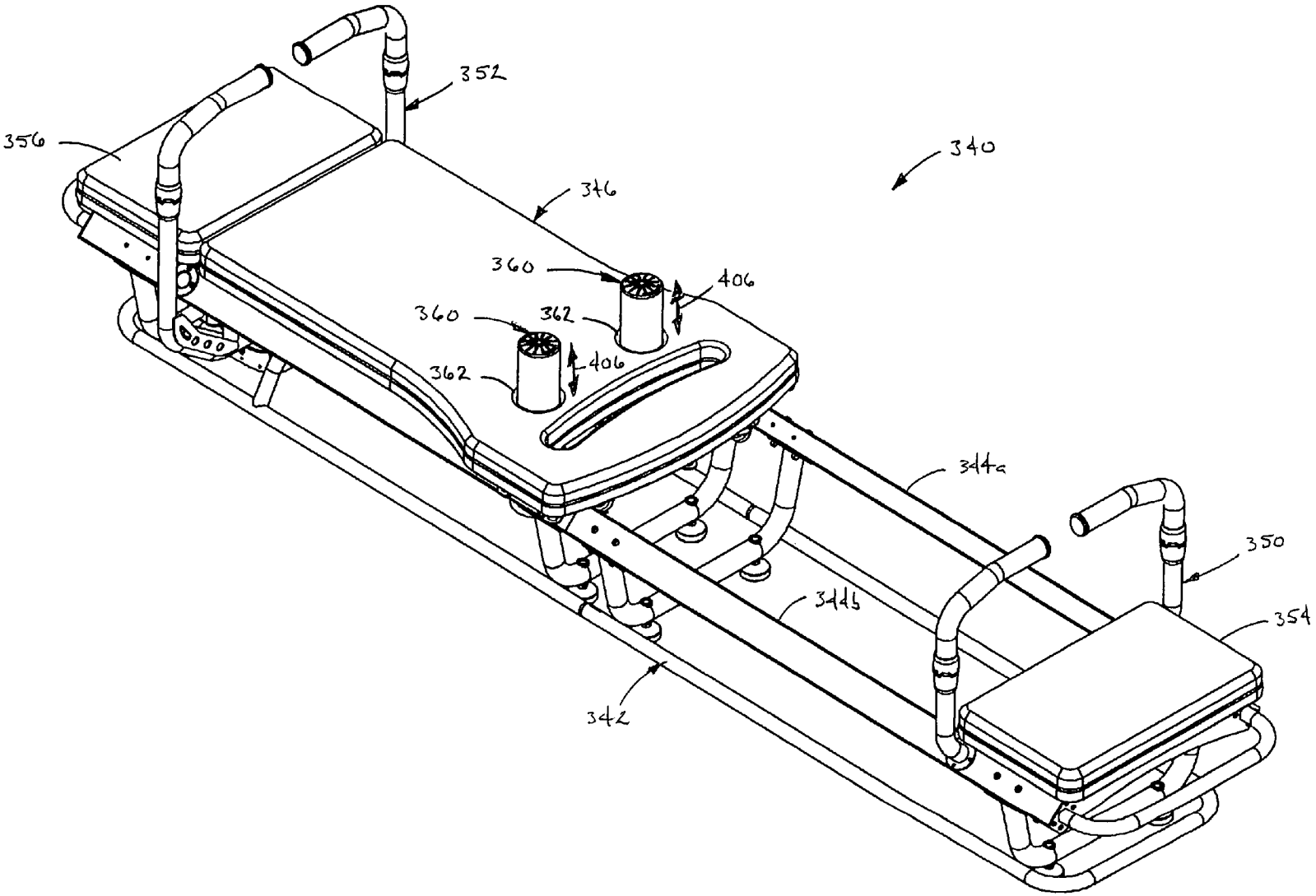
FIG. 31 is a head end perspective view of an exercise machine in accordance with another preferred embodiment of the present invention, in which the movable carriage assembly of the machine includes first and second shoulder pad assemblies that are selectively retractable from a raised position in which they engage a user's shoulders to a lowered position in which the upper ends of the pads are depressed level with or below the upper surface of the carriage platform.
Figure 32A:
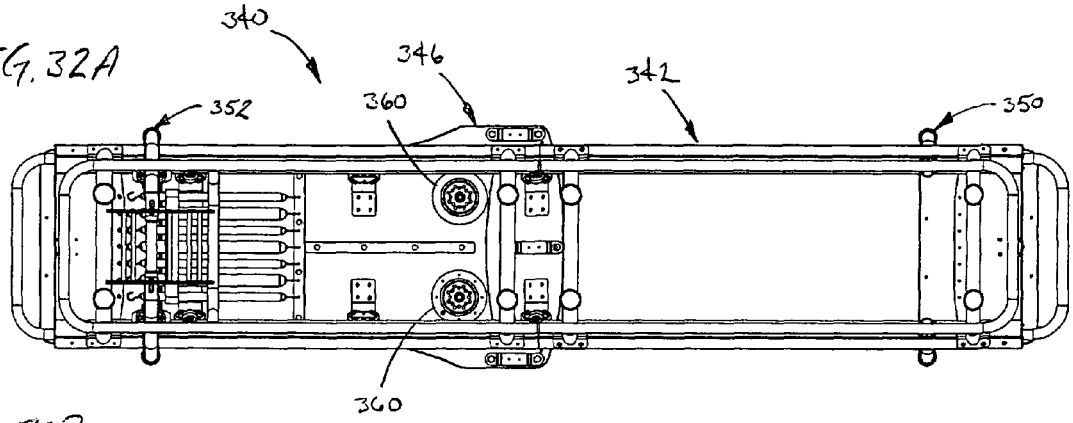
FIGS. 32A-32B and 32C are, respectively, bottom plan, side elevation and top plan views of the exercise machine of FIG. 31, showing the relationship of the retractable shoulder pad assemblies to the carriage assembly in greater detail.
Figure 32B:
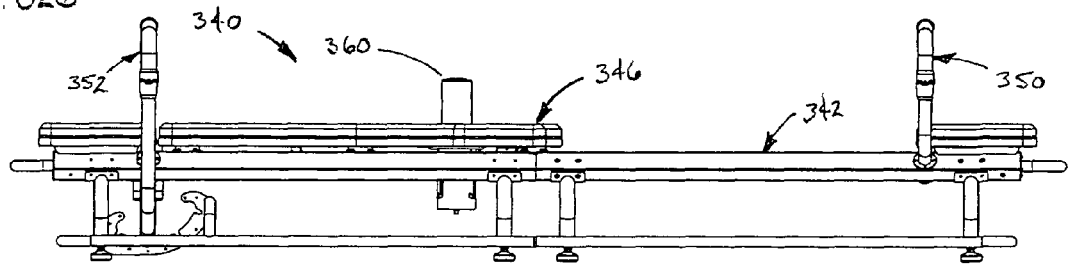
Figure 32C:
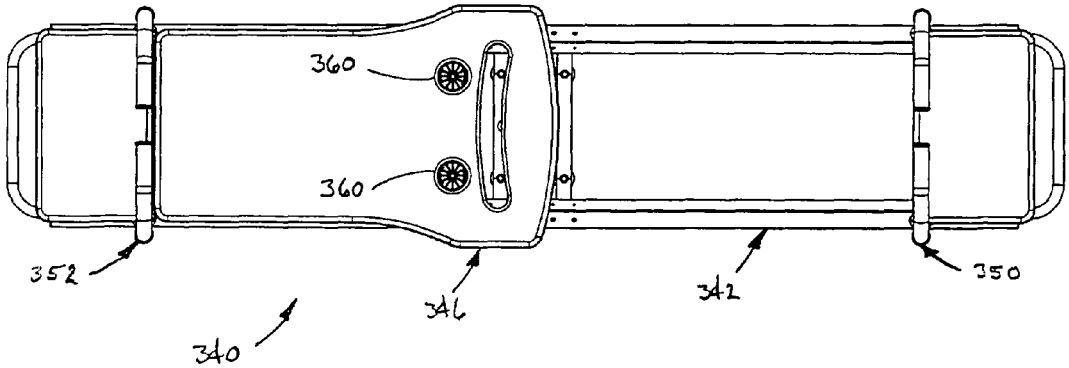

FIGS. 31-32C show an exercise machine 340 in accordance with another embodiment of the present invention, having a frame assembly 342 with longitudinal rails 344*a*, 344*b*, a moving platform 346, head-end and foot-end adjustable bar assemblies 350, 352, and head-end and foot-end stationary platforms 354, 356, all of which are substantially similar to the corresponding elements described above and therefore will not be described further here.

However, in the embodiment illustrated in FIGS. 31-32C, the platform assembly 346 further includes first and second retractable shoulder pad assemblies 360 set on a transverse line proximate the head end of the platform, and spaced apart by a distance sufficient to accommodate a user's head/neck so as to bear against the shoulders when the user is in a reclined position. The drawings show shoulder pad assemblies 360 in their raised position, however, as will be described in greater detail below, the pads can be selectively depressed through openings 362 formed vertically through the platform so that the upper ends of the pads lie flush with or below the upper surface thereof.

Figure 3:
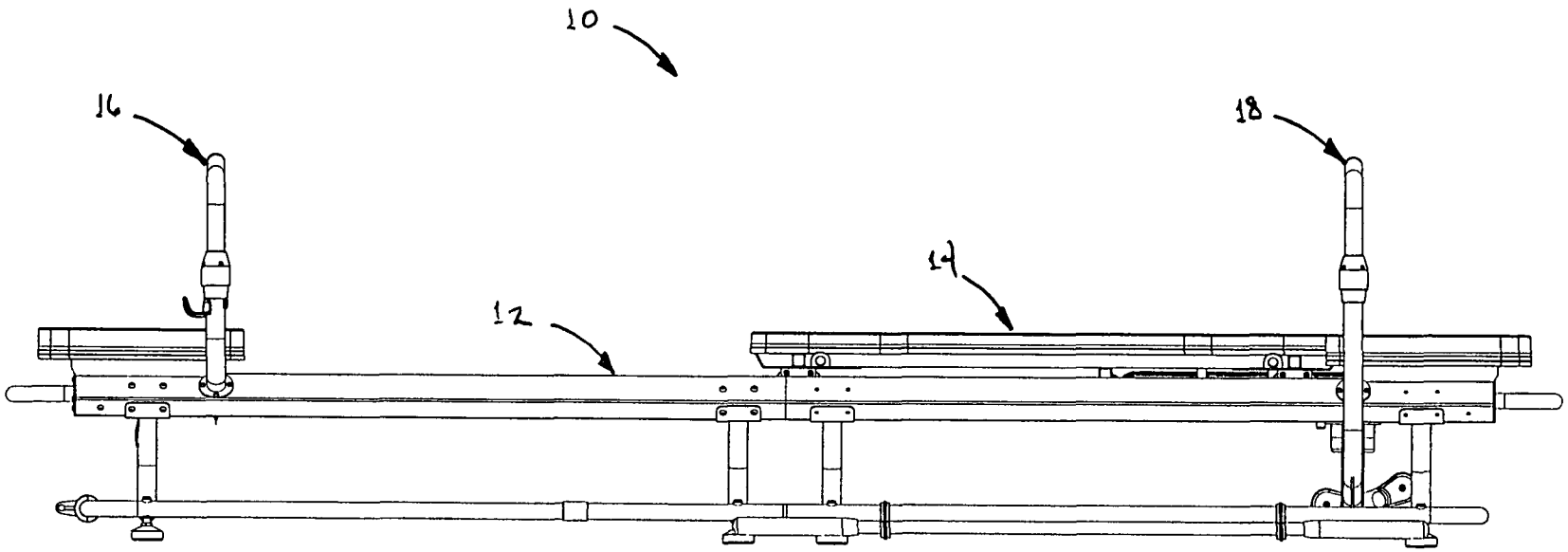
FIG. 3 is a side elevational view of the exercise machine of FIGS. 1-2.
Figure 4:
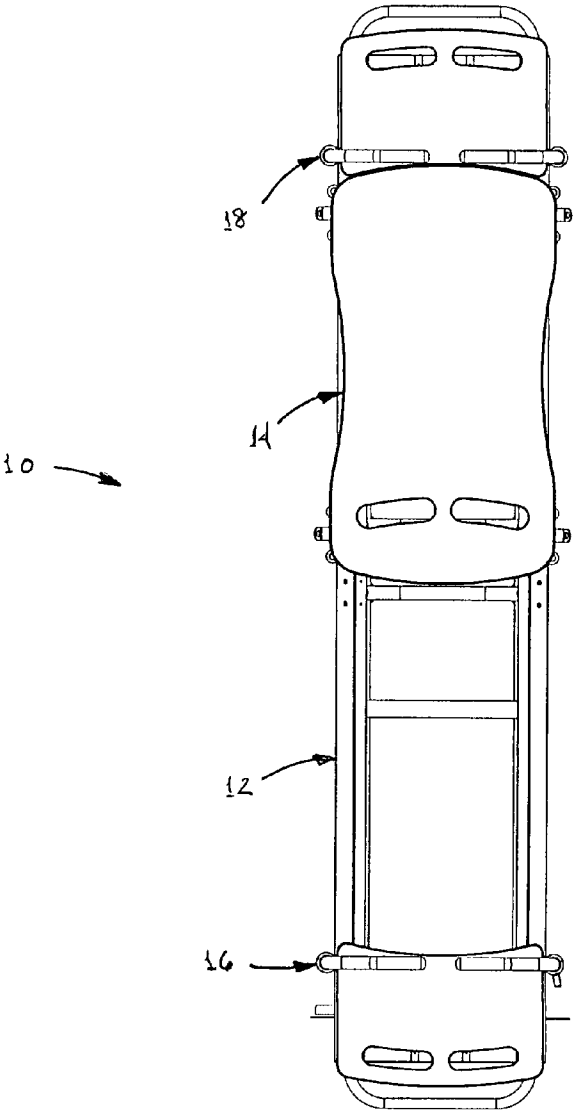
FIG. 4 is a top plan view of the exercise machine of FIGS. 1-3.
Figure 5:
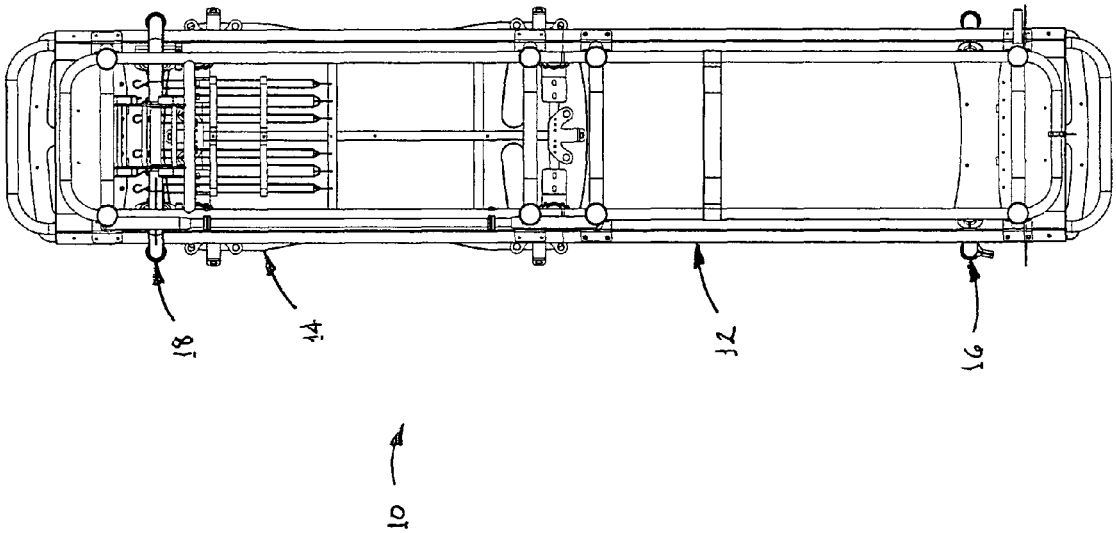
FIG. 5 is a bottom plan view of the exercise machine of FIGS. 1-4.

As can be seen in greater detail in the exploded view of FIG. 3, each of the shoulder pad assemblies 360 includes a vertically extending, generally cylindrical pad member 364 set within a collar-like piston member 366 over a rigid core member 368. The cylindrical surface 370 of the pad member is resiliently yielding so as to provide cushioning contact with a user's shoulder, and is suitably formed of a self-skinning foam material. In the preferred embodiment that is illustrated, the pad member is formed by the foam material over the rigid core member 368; the latter is suitably constructed of a segment 372 of steel pipe having a plug 374 welded in its upper end and an annular plate 376 welded about its lower end, the pipe segment 372 passing through a cooperating bore 378 in the piston member 366 and having a plurality of raised, bump-like protrusions 380 formed on its surface (suitably, by spot welds) to form an engagement with the over-moulded foam material. Addition protrusions 382 are formed on the inside of the piston member to form an engagement with the bottom end of the foam pad member, a protective cap 384 formed of durable plastic or similar material being mounted over the opposite, upper end of the pad member.

Figure 33:
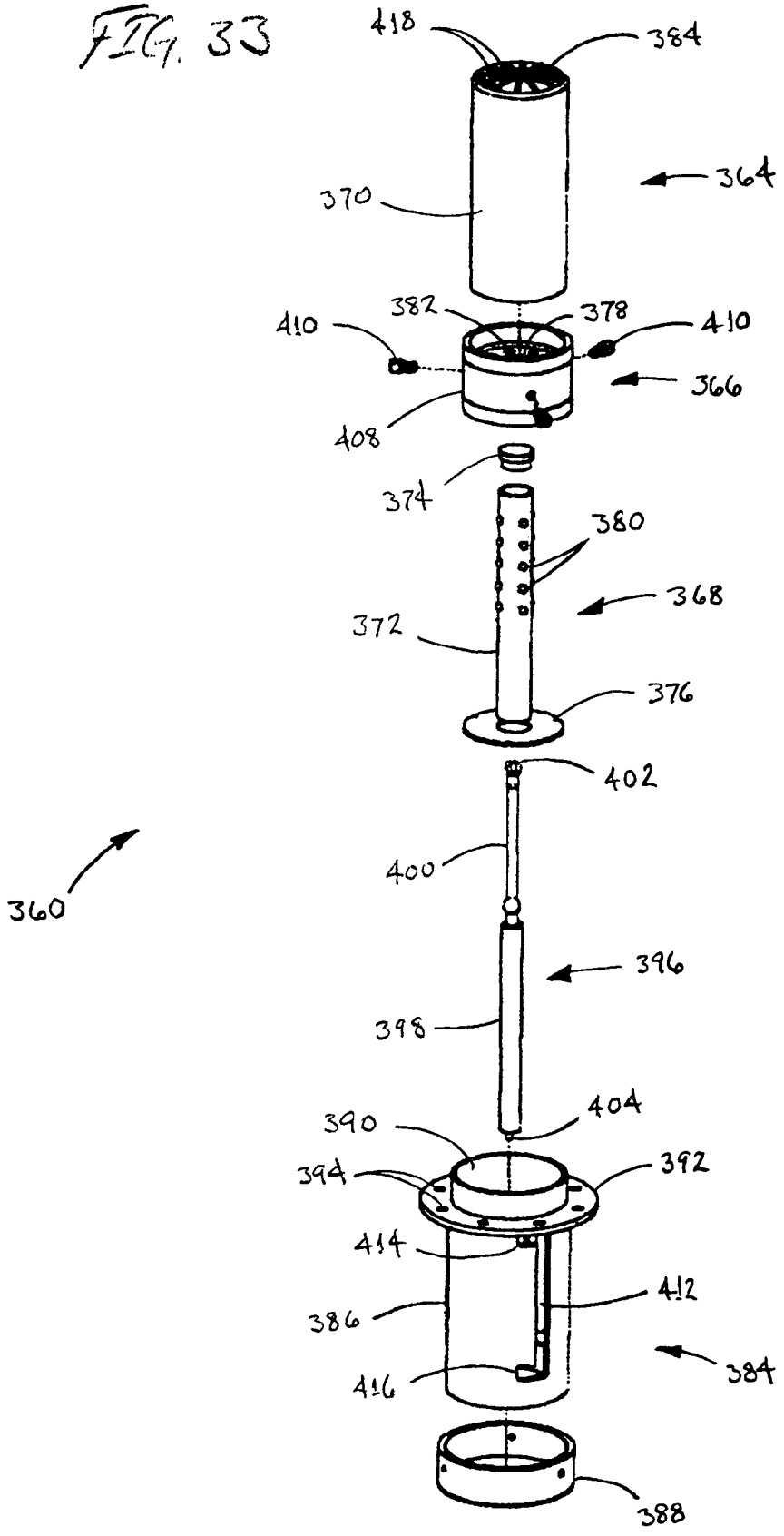
FIG. 33 is an exploded view of one of the retractable shoulder pad assemblies of the exercise machine of FIGS. 31-32C, showing the components and structure thereof in greater detail.

As can be seen with further reference to FIG. 33, the assembly 360 also includes a base section 384 having a cylindrical sleeve member 386 sized in length and diameter to receive the piston member 366 with the pad 364 thereon. The bottom of the sleeve member is closed by an end cap 388, while the upper end 390 is open for passage of the piston and cushion therethrough. An annular flange 392 having screw holes 394 is mounted around sleeve member 386 proximate the open upper end thereof, for mounting the base section 384 of the assembly to the bottom surface of the platform 14 as seen in FIGS. 32A-C.

A gas spring 396 including a cylinder 398 and rod 400 is installed vertically between the piston/cushion and base section, the rod 400 having a ball tip 402 that engages a cooperating hemispherical recess (not shown) in the cap 374 of core 368, and the bottom of the cylinder 398 having a projecting pin 404 that fits within a cooperating socket (now shown) in the base cap 388. Depressing the cushions 364 from their raised position thus results in compression of the gas springs 396, so that when released the pads return to their raised position, as indicated by double ended arrows 406.

The cylindrical exterior 408 of the piston member forms a sliding engagement with the interior of the tubular sleeve 386 so as to guide the cushion and maintain vertical alignment during a reciprocating movement. Guide screws 410 are installed at spaced locations around piston member 366 so that the heads thereof project radially from surface 408. The head of each guide screw is captured in a vertical guide slot 412 (one only visible in FIG. 33) so as to be able to slide longitudinally therethrough as the pads are reciprocated vertically. Horizontal slots 414, 416 are in turn formed at the upper and lower ends of each slot 412, into which the heads of the guide screws can be rotated when at the limits of the vertical slot.

The pad assembly can therefore be locked in the retracted position by depressing the pad and piston member into sleeve 386, so that the heads of the guide screws travel downwardly through vertical slots 412, then rotating the pad and piston so that the heads of the guide screws enter the lower horizontal slot segments 416 (in a clockwise direction in the embodiment that is illustrated), the caps 418 on the head members preferably being provided with raised ribs or similar features to aid the user's hand in depressing and rotating the members. To return the assembly to the extended configuration, the user rotates the pad and piston in a reverse direction, until the heads of the guide screws again enter the vertical slots 412; the user then releases the pad member so that the pressure exerted by gas spring 396 causes the piston and pad member to rise with the screw heads moving upwardly to the vertical limit of slots 412, at which point the pad and piston are rotated again to move the heads of the guide screws into the upper horizontal slot segments 412 and thereby lock the assembly in the extended position.

The air spring employed in the illustrated embodiment provides significant advantages in terms of controlled motion and ease of use, however, it will be understood that other or additional mechanisms may be included to bias or drive the pad members towards the raised position, such as coil compression springs for example.

It is to be recognized that various alterations, modifications, and/or additions may be introduced into the constructions and arrangements of parts described above without departing from the spirit or ambit of the present invention.

What is claimed is:

1. An exercise machine, comprising:

a frame having first and second ends;

a platform mounted on said frame so as to be reciprocatingly moveable towards said first and second ends thereof; and at least one bar assembly comprising a pair of upright bars mounted on opposite sides of said frame, said upright bars each comprising:

a lower bar member extending generally upwardly from said frame;

an upper bar member having a grip portion extending generally horizontally so as to be accessible to a user on said platform; and a coupling rotatably connecting said upper bar member to said lower bar member so that said generally horizontal grip portion is selectively rotatable to a plurality of positions for differing exercises performed on said machine, said coupling comprising:

a first coupling member mounted to an upper end of said lower bar member;

a second coupling member mounted to a lower end of said upper bar member; and a spring yieldingly biasing said first and second coupling members into a locking engagement;

so that in response to a user applying force to said upper bar segment against said spring said first and second coupling members are separated from said locking engagement to allow said grip portion to be rotated to a selected position, and in response to a user releasing said upper bar member said first and second coupling members are biased into said locking engagement so as to retain said grip portion in said selected position.

2. The exercise machine of claim 1, wherein said spring yielding biasing said first and second coupling members into said locking engagement:

biases said lower end of said upper bar member towards said upper end of said lower bar member.

3. The exercise machine of claim 1, wherein said first and second coupling members comprise:

first and second castellated members having cooperating teeth and notches that form said locking engagement.

4. The exercise machine of claim 2, wherein said at least one bar assembly further comprises:

a horizontal axis pivot connection between said bar assembly and said frame that allows said upright bars to be selectively rotated about a horizontal axis to a plurality of angles for differing exercises performed on said machine.

5. The exercise machine of claim 4, wherein said horizontal axis pivot connection comprises:

a horizontal cross-member interconnecting said lower bar members of said upright bars; and at least one bearing mounted to said frame that supports said cross-member for rotation about said horizontal axis relative to said frame.

6. The exercise machine of claim 4, further comprising:

a locking mechanism that selectively locks said upright bars in said plurality of angular positions.

7. The exercise machine of claim 6, wherein said locking mechanism comprises:

a retractable plunger member mounted to at least one of said lower bar members;

a locking member mounted to said frame and having a plurality of openings that receives said plunger member in locking engagement therewith when said bars are in said angular positions; and means for selectively retracting and extending said plunger member on said bar member from and into said openings in said locking member.

8. The exercise machine of claim 7, wherein said means for selectively retracting and extending said plunger member comprises:

a cable connecting said plunger member to an upper bar member via said lower bar member, so that in response to a user lifting said upper bar member tension on said cable retracts said plunger member from said openings in said locking member, and in response to a user releasing said upper bar member slack in said cable allows said plunger member to extend into said openings in said locking member.

9. The exercise machine of claim 8, wherein said spring biasing said lower end of said upper bar member towards said upper end of said lower bar member comprises:

a compression spring mounted intermediate said plunger member and said lower bar member so as to exert tension on said cable while biasing said plunger member towards an extended position.

10. The exercise machine of claim 1, wherein said frame comprises:

first and second substantially parallel rail members that support cooperating roller assemblies on said platform.

11. The exercise machine of claim 10, wherein said rail members each comprise:

a downwardly sloped upper surface and an upwardly sloped lower surface converging towards a medial side of said rail member.

12. The exercise machine of claim 11, wherein said downwardly sloped upper surface and upwardly sloped lower surface extend at angles of about 45° to horizontal.

13. The exercise machine of claim 12, wherein said first and second rail members comprise:

first and second substantially rectangular tube members mounted so that all sides thereof extend at angles of approximately 45° to horizontal.

14. The exercise machine of claim 11, wherein said roller assemblies on said platform each comprise:

at least one upper roller wheel that engages one of said upper sloped surfaces substantially normal thereto; and at least one lower roller wheel that engages one of said lower sloped surfaces substantially normal thereto.

15. The exercise machine of claim 14, wherein said roller assemblies are mounted in outwardly facing pairs on opposite sides of said platform, said pairs of roller assemblies being spaced apart by a distance sufficient that said sloped upper and lower surfaces of said medial sides of said rail members are captured between said upper and lower roller wheels so as to restrict vertical movement of said platform relative to said frame.

16. The exercise machine of claim 10, furthering comprising:

a spring yieldingly biasing said platform towards one of said ends of said frame.

17. The exercise machine of claim 16, wherein said spring yieldingly biasing said platform towards one of said ends of said frame comprises:

at least one tension spring interconnecting said platform and said frame.

18. An exercise machine comprising:

a frame assembly having a head end and a foot end, said frame assembly comprising:

first and second parallel, spaced apart rail members having a rectangular cross-section, said rail members being mounted level with one another and with sides extending at angles of approximately 45° to horizontal, so that medially facing sides of said first and second rail members form downwardly sloped upper surfaces and upwardly sloped lower surfaces;

a platform assembly located on said rail members, said platform assembly comprising:

a generally horizontal platform member;

a plurality of roller assemblies that support said platform member on said rail members for movement thereover towards said head end and said foot end of said frame assembly, said roller assemblies each comprising upper and lower roller members that engage said sloped upper and lower surfaces of one of said rail members substantially normal thereto, said roller assemblies being mounted in opposing pairs on said platform member and spaced apart laterally by a distance sufficient that said medially facing sides of said first and second rail members are captured intermediate said opposing pairs of roller assemblies so as to restrict vertical movement of said platform assembly on said frame assembly; and at least one tension spring yieldingly biasing said platform towards said foot end of said frame assembly; and at least one adjustable bar assembly comprising a pair of upright bars mounted on opposite sides of said frame assembly, said upright bars each comprising:

a lower bar member extending generally upwardly from said frame assembly;

an upper bar member having a grip portion extending generally horizontally so as to be accessible to a user on said platform; and a coupling rotatably connecting said upper bar member to said lower bar member so that said generally horizontal grip portion is selectively rotatable to a plurality of positions for differing exercises performed on said machine, said coupling comprising:

a first coupling member mounted to an upper end of said lower bar member;

a second coupling member mounted to a lower end of said upper bar member; and a spring yieldingly biasing said first and second coupling members into a locking engagement;

so that in response to a user applying force to said upper bar segment against said spring said first and second coupling members are separated from said locking engagement to allow said grip portion to be rotated to a selected position, and in response to a user releasing said upper bar member said first and second coupling members are biased into said locking engagement so as to retain said grip portion in said selected position.

19. The exercise machine of claim 18, comprising:

first and second adjustable bar assemblies mounted to said frame assembly proximate said head end and said foot end thereof, respectively.

20. The exercise machine of claim 19, wherein said first adjustable bar assembly mounted proximate said head end of said frame assembly further comprises:

means for fixedly mounting said lower bar members of said first bar assembly to said first and second rail members proximate said head end of said frame assembly.

21. The exercise machine of claim 20, wherein said second adjustable bar assembly mounted proximate said foot end of said frame assembly comprises:

a horizontal axis pivot connection between said second adjustable bar assembly and said frame assembly that allows said upright bars thereof to be selectively rotated about a horizontal axis to a plurality of angles for differing exercises performed on said machine.

22. An adjustable bar assembly for an exercise machine, said adjustable bar assembly comprising:

a pair of upright bars mountable on opposite sides of a frame of an exercise machine, said upright bars each comprising:

a lower bar member extending generally upwardly from said frame;

an upper bar member having a grip portion extending generally horizontally so as to be accessible to a user on said exercise machine; and a coupling rotatably connecting said upper bar member to said lower bar member so that said generally horizontal grip portion is selectively rotatable to a plurality of positions for differing exercises performed on said exercise machine, said coupling comprising:

a first coupling member mounted to an upper end of said lower bar member;

a second coupling member mounted to a lower end of said upper bar member; and a spring yieldingly biasing said first and second coupling members into a locking engagement;

so that in response to a user applying force to said upper bar segment against said spring said first and second coupling members are separated from said locking engagement to allow said grip portion to be rotated to a selected position, and in response to a user releasing said upper bar member said first and second coupling members are biased into said locking engagement so as to retain said grip portion in said selected position.

23. The adjustable bar assembly of claim 22, wherein said at least one bar assembly further comprises:

a horizontal axis pivot connection between said bar assembly and said frame that allows said upright bars to be selectively rotated about a horizontal axis to a plurality of angles for differing exercises performed on said machine.

24. The adjustable bar assembly of claim 23, further comprising:

a locking mechanism that selectively locks said upright bars in said plurality of angular positions.

* * * * *